US007313829B1

(12) United States Patent
Serra et al.

(10) Patent No.: US 7,313,829 B1
(45) Date of Patent: Jan. 1, 2008

(54) SEALING DEVICE FOR BODY SUIT AND SEALING METHOD USING HYDROGELS

(75) Inventors: Marco Serra, Lucca (IT); Timothy Alan Sutherland, Cambridge, MA (US); Hermanus Stephanus Pretorius, Derry, NH (US); Cleveland Arthur Heath, Medfield, MA (US); Jerrell Edward Jarvis, Fort Wayne, IN (US)

(73) Assignee: Payload Systems, Inc., Cambridge, MA (US)

( * ) Notice: Subject to any disclaimer, the term of this patent is extended or adjusted under 35 U.S.C. 154(b) by 0 days.

(21) Appl. No.: 11/264,187

(22) Filed: Oct. 31, 2005

Related U.S. Application Data

(60) Provisional application No. 60/623,517, filed on Oct. 29, 2004.

(51) Int. Cl.
*B63C 11/02* (2006.01)
*B63C 11/04* (2006.01)
*B63C 11/52* (2006.01)

(52) U.S. Cl. ..... 2/2.15; 2/2.16; 2/2.17

(58) Field of Classification Search ..... 2/2.15, 2/2.16, 2.17
See application file for complete search history.

(56) References Cited

U.S. PATENT DOCUMENTS 3,731,319 A 5/1973 O'Neill
3,958,275 A 5/1976 Morgan et al.
3,975,350 A * 8/1976 Hudgin et al. ..... 524/108
4,015,295 A 4/1977 Lancaster et al.
4,365,351 A 12/1982 Doerschuk et al.
4,464,795 A * 8/1984 Long et al. ..... 2/2.17
4,547,904 A * 10/1985 Long et al. ..... 2/2.16
5,130,199 A 7/1992 Howard
5,483,697 A * 1/1996 Fuchs ..... 2/161.7
5,647,059 A 7/1997 Uglene et al.
5,802,609 A * 9/1998 Garofalo ..... 2/2.17
5,863,551 A * 1/1999 Woerly ..... 424/423
5,978,960 A * 11/1999 Wrightman ..... 2/2.15
6,055,982 A * 5/2000 Brunson et al. ..... 128/206.12
6,082,360 A * 7/2000 Rudolph et al. ..... 128/206.25
6,095,207 A 8/2000 Enders
6,240,321 B1 5/2001 Janke et al.
6,415,449 B2 7/2002 Duplock
6,605,294 B2 * 8/2003 Sawhney ..... 424/426
6,653,420 B2 * 11/2003 Domschke et al. ..... 526/258

(Continued)

*Primary Examiner*—Gary L. Welch
*Assistant Examiner*—Robert H Muromoto, Jr.
(74) *Attorney, Agent, or Firm*—George W. Neuner; Steven M. Jensen; Edwards Angell Palmer & Dodge LLP

(57) ABSTRACT

A sealing device for a body suit and a sealing method utilize a reactive seal that incorporates a swelling polymer activated upon contact with a fluid medium, such as water. The reactive seal can be embodied in a neck seal, wrist seal, or ankle seal of the body suit, where the reactive seal is designed to be loose and comfortable to wear, only exerting sealing pressure when needed. The swelling polymer can be a superabsorbent hydrogel such as a blend of polyacrylate polymer with poly-anionic beads (PAB). In one application, a 50/50 blend of polyacrylate and PAB is used, such that the reactive seal can autonomously tighten within about 10 to 15 seconds. The device and method can be used in various other applications to form a seal for preventing the passage of fluid from one volume to another.

25 Claims, 16 Drawing Sheets

U.S. PATENT DOCUMENTS 6,668,386 B2 12/2003 Vidal
6,698,510 B2 * 3/2004 Serra et al. ..... 165/185
6,764,474 B2 * 7/2004 Nielsen et al. ..... 604/344
6,770,721 B1 * 8/2004 Kim ..... 526/329
6,855,410 B2 * 2/2005 Buckley ..... 428/311.11
6,897,271 B1 * 5/2005 Domschke et al. ..... 526/91
6,901,288 B2 * 5/2005 Janke et al. ..... 607/9
6,927,316 B1 * 8/2005 Faries et al. ..... 602/43
6,943,211 B1 * 9/2005 Hubbell et al. ..... 524/556
6,969,399 B2 * 11/2005 Schock et al. ..... 607/108
6,979,324 B2 * 12/2005 Bybordi et al. ..... 604/313
6,998,510 B2 * 2/2006 Buckman et al. ..... 602/48
7,009,034 B2 * 3/2006 Pathak et al. ..... 530/200
7,056,310 B2 * 6/2006 Tanaka et al. ..... 604/327
7,062,786 B2 * 6/2006 Stinton ..... 2/2.15

* cited by examiner

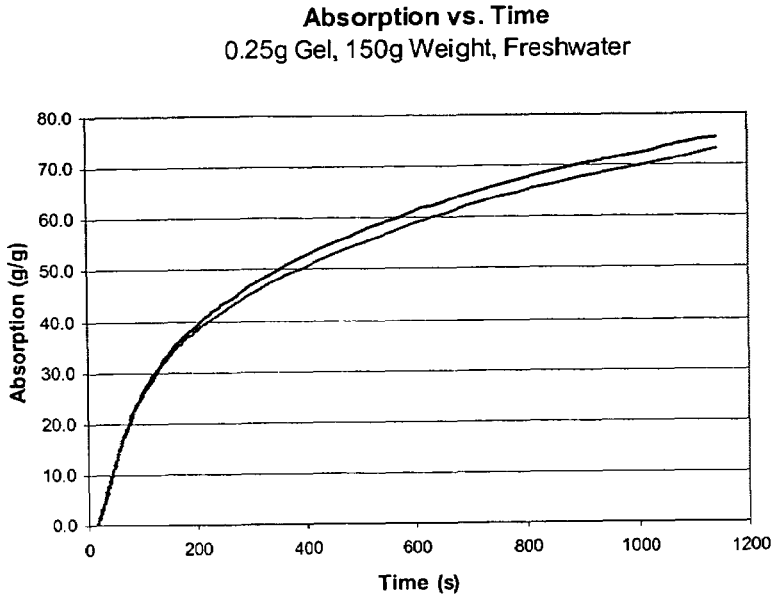
FIG. 20: Comparison of fresh water absorption of two suitable polymer blends
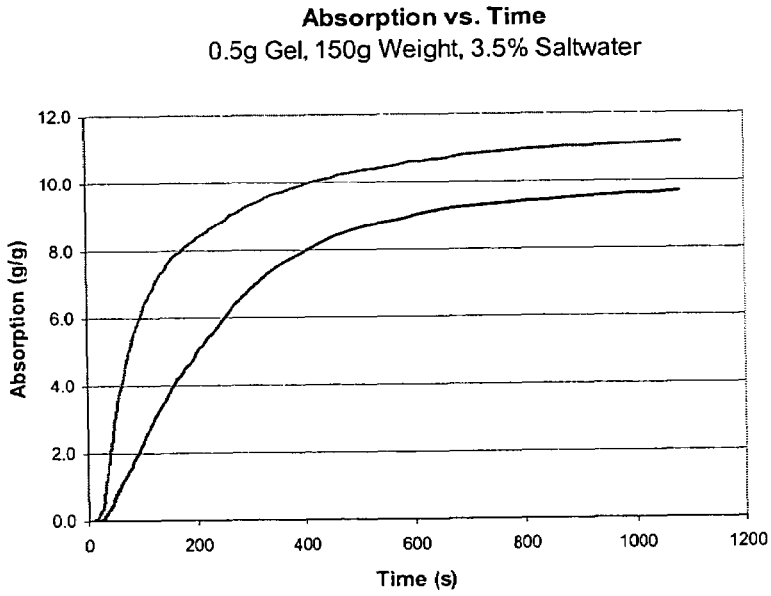
FIG. 21: Comparison of salt water absorption of two suitable polymer blends

SEALING DEVICE FOR BODY SUIT AND SEALING METHOD USING HYDROGELS

CROSS-REFERENCE TO RELATED APPLICATION

This application claims the benefit of U.S. Provisional Application Ser. No. 60/623,517 filed on Oct. 29, 2004, the entire contents of which are incorporated by reference herein.

STATEMENT REGARDING FEDERALLY SPONSORED RESEARCH

This invention was made with U.S. Government support under contract numbers N00421-04-C-008-CFI004 and N00421-04-C-0149, monitored by U.S. Naval Air Command. The Government has certain rights in the invention.

FIELD OF INVENTION

The present invention relates to sealing devices for body suits, and more particularly to systems and methods incorporating polymers, with or without reversibility characteristics, that respond to the presence of certain triggering conditions to form a seal that prevents the passage of fluid from one volume to another.

BACKGROUND OF THE INVENTION

Neck seals used in survival suits and dry suits are generally made of tight fitting neoprene or latex to provide a seal against the ingress of water when the user is submerged. The tight fit that is required to ensure the sealing function makes them uncomfortable to wear and restricts neck and head movement. Furthermore, the permanent seals at the extremities of these garments prevent the exchange of air, giving rise to the possibility of overheating when the user is not submerged.

Naval aviators generally wear specially designed survival suits as part of their flight gear because most of their flying is done over water. They often spend hours in the cockpit or helicopter bay during the performance of their missions. One of the most common complaints with respect to their equipment is the lack of comfort that is a characteristic of current neck seal technology. The tight fit of conventional neck seals restricts head movement and presses on the throat, which can eventually hamper communication. If the fit is too tight it can even affect circulation. Attempts have been made to design seals that allow for head movement. One design features a latex neck seal with a bellows section. In principle this should solve the mobility problem, but in practice the folds of the bellows tend to limit movement, particularly twisting of the neck, because of high friction between self-contacting parts of the device. Another design is the simple neoprene neck seal commonly used in many body suit applications. While more comfortable to wear than latex, the neoprene seal must be tight to ensure a seal during submersion, resulting in a tight fit even when the user is not in the water. Neither of these designs addresses airflow.

Various attempts have been made at solving the sealing problem in a variety of fields and applications. For example, U.S. Pat. No. 3,731,319 to O'Neill discloses a diving suit in which seals around the neck, wrists, and ankles are formed by folding inwardly the fabric around these extremity openings to create a tight seal against the skin. This approach is similar to many existing tight fitting seals, and does not suitably address user comfort. Other examples of tight fitting seals include U.S. Pat. No. 6,415,449 (survival garment with neck seal, wrist seals, and ankle seals made of an elastic material); U.S. Pat. No. 3,958,275 to Morgan et al. (diving helmet with neoprene or rubber neck dam supported by a rigid plate); and U.S. Pat. No. 4,015,295 to Lancaster et al. (neck seal having multiple rigid parts).

U.S. Pat. No. 5,802,609 to Garofalo discloses a diving suit that uses a ring of elastomeric material to form a toroidal seal around the arm, leg, and neck openings of a dry suit. In Garofalo, the seal is formed by a hem that is folded inwardly and secured to form a tubular pocket that contains a tape-like elastomeric ring as a stiffening element. As a result, pressure from the tight fitting suit is concentrated underneath the ring, forming a toroidal seal section. In Garofalo, this pressure is always present and the seal does not distinguish between wet and dry conditions.

Attempts have also been made to solve the comfort problem in neck seals used in dry suits and survival suits. U.S. Pat. No. 6,668,386 to Vidal discloses an adjustable neck seal for use with dry suits which includes a flexible tube surrounding an opening, and an elastic pull cord positioned within the tube for adjusting the seal. In Vidal, the wearer can adjust the tightness of the neck seal as necessary. However, a user-adjusted neck seal is undesirable in garments that are used as safety devices, which are designed to function regardless of the state of consciousness of the wearer.

U.S. Pat. No. 4,365,351 to Doerschuck et al. discloses a design for neck and wrist seals that uses a thick open celled foam section with a watertight skin to provide the seal. The seals are cylindrical in external shape with inner surfaces that are conical and cylindrical. A conical section is bonded to the suit with non-stretch tape, and the remainder of the seal expands when the user pushed his hand or head through. Although this approach attempts to make the seals more comfortable, it does not offer any variation in seal fit between the dry and wet states and therefore is essentially a common tight fitting seal.

U.S. Pat. No. 5,647,059 to Uglene et al. discloses a design for an inflatable seal constructed in three layers. An inflatable layer is sandwiched between a deformable inner layer and a non-stretch outer layer that directs the expansion toward the neck. In Uglene et al., the seal is permanent once donned and is not activated or established by the presence of water. The approach utilized in Uglene et al. is simply aimed at making the donning and doffing easier and in providing some level of adjustability for the user to regulate his or her level of comfort. However, an inflatable design would be inappropriate in an application which requires functioning under emergency conditions. Using the design of Uglene et al., the wearer would need to consciously ensure that the neck seal is inflated, which would be impossible if the wearer became unconscious due to a crash or the like.

U.S. Pat. No. 6,082,360 to Rudolph et al. discloses a respiratory mask and seal. The seal is made of a hydrogel described as sticky, resilient, self-sustaining, and non-flowable. Although the class of material used in this seal is that of polymer hydrogels, the material used has no ability to change its form substantially in response to the presence of fluid. Moreover, such a hydrogel would be unable to develop a sealing pressure.

U.S. Pat. No. 6,240,321 to Janke et al. discloses an expandable seal for use with a medical device such as an implanted lead with an open lumen tip. The seal, which can be part of the tip or can be deployed separately, swells over time to limit the amount of fluid that enters the device. The hydrogel matrix in Janke is composed of a silicone and glycerol blend; in experiments, the amount of glycerol was varied between 10% and 40% by weight percentage, with the total amount of expansion being measured over 150 days. However, the silicone-glycerol blend utilized in Janke cannot be classified as a superabsorbent polymer, due to its low swelling ratio, i.e., an expansion of about four times the original volume over 150 days. Moreover, silicone-glycerol hydrogel seals would not be suitable for use in a body suit, because they do not satisfy the requirements of a fast swelling speed and a high degree of swelling.

U.S. Pat. No. 6,698,510 to Serra et al. discloses a thermal regulation device that uses a reversible, thermosensitive hydrogel embedded in a foam matrix to control the rate of water flow in a wet suit. The mechanism works by regulating the permeability of a water transport layer, thereby controlling the rate of flow and, as a result, the convective heat transfer. The foam matrix with an embedded gel taught in Serra et al. could never form an effective seal because the structure of the foam matrix would always present a wicking path for the water to be transported through the structure. Although the foam matrix would be sufficient to significantly impact convection, it is not adequate for the purpose of providing a seal.

It would be desirable to provide an improved sealing device and sealing method for use in body suits, for forming a seal in response to a change of environmental conditions, which possesses characteristics such as a fast swelling speed and a high degree of swelling. The sealing device and related methods should overcome the deficiencies of the presently available methods and systems.

SUMMARY OF THE INVENTION

A sealing device for a body suit and a sealing method according to the present invention utilize a reactive seal that incorporates a swelling polymer activated upon contact with a fluid medium such as water. The swelling polymer can be a superabsorbent hydrogel that functions in fresh water and/or salt water, preferably in both fresh water and salt water of varying concentrations, as typically found in oceans. The device and method can be used with any suitable type of body suit, including but not limited to: survival suits, wet suits, dry suits, exposure suits, and immersion suits. The sealing device can be provided as a neck seal on the body suit, and also can be incorporated into wrist and ankle seals to render them more comfortable to wear, such that sealing pressure is applied only when needed. The present invention also encompasses the body suit itself which can incorporate one or more sealing devices as described herein.

The device and method can be used in various other applications to form a seal that prevents the passage of fluid from one volume to another, e.g., any sealing application in which a space must be sealed in response to a change in environmental conditions. The space to be sealed can be located between one or more holes and shafts of arbitrary size and shape, or could simply be a hole, tube, or the like.

According to one embodiment of the present invention, the sealing device is placed at the neck opening of a body suit, and provides a reactive seal that seals the annular opening between the suit and the neck of the wearer. The neck seal can be contained in a fabric section of the body suit, which is in initial light contact with the neck of the user, ensuring a comfortable fit when the user is dry. Upon wetting, the superabsorbent hydrogel becomes swollen, and the reactive seal takes its shape to exert sealing pressure and inhibit the entry of water into the volume of the body suit. The presence of water is all that is required to activate the superabsorbent hydrogel, which preferably has a high degree of swelling and a high swelling speed in both fresh water and salt water. When activated, the seal tightens and substantially prevents water from entering the body suit, thereby keeping the user dry.

In one particular application, the body suit is a survival suit designed to be worn by aviators. The sealing device provides a comfortable neck seal under normal operating conditions, allowing airflow through the neck opening. The sealing device incorporates a superabsorbent hydrogel designed to be activated in an emergency situation such as when the wearer becomes submerged in an ocean or other body of water, at which time the superabsorbent hydrogel swells and autonomously seals the neck opening. The sealing device can be used as a neck seal as described, and can also be used to form wrist seals and ankle seals according to the present invention.

A sealing device according to the present invention can be used in another application for sealing a large, enclosed area, such as the basement of a house, to prevent flooding of the enclosed area. The sealing device can include a polymer powder filled into a frame, which provides a path for air to flow. Normally, air flows freely through the frame when the polymer powder is in a dry state. Upon contacting water, the polymer powder reacts with water to expand and block airflow through the frame, thus preventing ingress of water into the enclosed area.

A further application incorporates a sealing device into a door and window seal, where the door or window is provided with a groove along its outer edge circumference for receiving a rubber element incorporating a polymer powder actuator. During wet conditions, water penetrates the groove and the polymer powder expands to prevent flooding.

Yet a further application of the present invention is a shaft seal that controls flow around the shaft, where the shaft seal can serve as a primary or secondary seal to restrict water flow.

Other aspects and embodiments of the invention are discussed below.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein:

FIG. 20 is a graph showing fresh water absorption over time of two polymer blends suitable for use in the present invention;

FIG. 21 is a graph showing salt water absorption over time of two polymer blends suitable for use in the present invention;

DEFINITIONS

Figure 1:
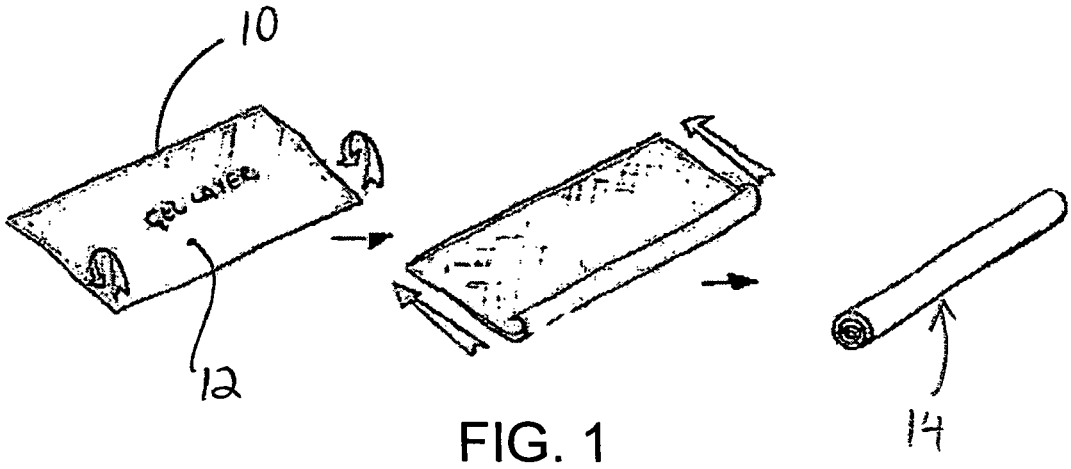
FIG. 1 is a schematic view illustrating steps in a method of constructing toroid seals useful in a sealing device according to the present invention.

The instant invention is most clearly understood with reference to the following definitions:

As used in the specification and claims, the singular form "a", "an" and "the" include plural references unless the context clearly dictates otherwise.

As used herein, a "body suit" refers to any article that can be worn by a user, including but not limited to: survival suits, wet suits, dry suits, exposure suits, and immersion suits.

DETAILED DESCRIPTION OF THE INVENTION

A sealing device for a body suit and a sealing method according to the present invention utilize a reactive seal incorporating a swelling polymer activated upon contact with a fluid medium, e.g., water. The reactive seal can be embodied in one or more of a neck seal, wrist seals, and ankle seals of a body suit, where the reactive seal is designed to be somewhat loose fitting and comfortable to wear, only exerting sealing pressure when needed.

The present invention also can be applied to other applications in which an annular passage between a shaft and a hole must be sealed in response to a change in conditions. For example, the device can be used in the extremity seals of wetsuits if it is desired to stop the flushing of water to increase warmth. The sealing mechanism, depending on the actuating polymer hydrogel used, can be reversible or non-reversible as required by the application.

A short description of the properties and behavior of hydrogels is provided, which is applicable to embodiments of the sealing device discussed herein.

Polymer gels are characterized by long chain polymer molecules that are crosslinked to form a network. This network is able to trap and hold fluid, which gives gels properties somewhere between those of solids and liquids. Depending on the level of crosslinking, various properties of a particular gel can be tailored. For example, a highly crosslinked gel will generally be structurally strong and would resist releasing fluid under pressure, but would exhibit slow transition times. A lightly crosslinked gel would be weak structurally, but would react quickly during its phase transition. In the design of gels for a particular application, it is important to adjust the degree of crosslinking to achieve the desired release of fluid.

According to the present invention, the polymer used as an actuating element preferably is a superabsorbent hydrogel. These polymers, generally based on sodium polyacrylate, are well known to be able to absorb hundreds of times their weight in fluid. The nature of the fluid, more specifically the concentration of sodium ions, in part determines the degree of absorption and swelling ratio. For example, the polymer may absorb 700 to 800 times its weight in distilled or deionized water, but this may drop to 300 times if the water is ordinary tap water and 100 times or less if salt water. This is because the water absorption is driven by a property called osmotic pressure, which the polymer strives to maintain balanced at zero differential with the environment. Osmotic pressure is the combination of the rubber elasticity of the polymer network, the polymer-polymer and polymer-solvent affinity, and the ionization of the polymer network. The rubber elasticity of the network provides a mechanical restoring force to changes in volume. The affinity of the polymer for itself and the solvent determines whether this component of osmotic pressure drives it to absorb fluid or not. Finally, the ionization of the network determines the driving force that will attempt to balance the ionization level of the polymer with that of the solvent in the surroundings. It is this last element of the osmotic pressure that offers the opportunity to tailor the polymer's behavior. By modifying the ionization of the polymer it is possible to affect the types of fluids that can be absorbed and the degree to which they are absorbed. For a given ionization, if the fluid contains a higher ionic concentration than the polymer, this component will not drive the absorption. On the other hand, if the fluid is deionized water, the driving force for absorption will be great and the swelling ratio correspondingly large.

A superabsorbent polymer useful in the present invention, in its original form, normally does not swell in ocean water, because of its high concentration of sodium ions. The sodium ions in ocean water compete with the polymer for the water molecules and since their affinity for water is greater than that of the polymer, the polymer does not absorb any water. Therefore, superabsorbent polymers that utilize sodium polyacrylate in its original form do not generally have suitable properties for use in sealing devices that are designed for use in body suits.

In the present invention, the sodium polyacrylate-based superabsorbent polymers have been modified to provide a substance having a greater affinity for sodium ions than the sodium ions have for water. The polymer preferably is a blend of a base sodium polyacrylate polymer with poly-anionic beads (PAB) that have an affinity for sodium ions, and a surfactant that assists in the absorption of water. Since the blend can be tailored to suit the application, and each component is useful depending on the application, the range of blend ratios can be between about 0% and 100% of sodium polyacrylate and PAB, for example 1:99, 2:98, 3:97, and so on. According to the present invention, one suitable ratio is 50:50, i.e. approximately equal parts of sodium polyacrylate polymer and PAB. Such a polymer blend has suitable speed and swelling ratio requirements for functioning in salt water, which are comparable to the performance of the unmodified sodium polyacrylate polymer in fresh water. It will be apparent to those skilled in the art that a wide range of polymers can be used in sealing devices of the present invention, depending on the desired performance and intended use. Sodium polyacrylate polymers have been used in diapers and other absorbent devices for many years because they have a high swelling capability and can swell in a matter of seconds. The sodium polyacrylate polymers useful in the present invention preferably are a blend of the base sodium polyacrylate polymer and poly-anionic beads, which can tolerate high sodium ion concentrations of up to about 10% sodium ions, such as those found typically in the oceans. This polymer blend preferably is provided in powder form.

The fast swelling and high bloat properties of some superabsorbent polymers make them especially suited to the invention described herein. Although not actively reversible, these superabsorbent polymers exhibit characteristics of reversibility, and will eventually shrink to their original size as the fluid trapped in the structure evaporates. Once shrunken they generally are reusable. However, in other embodiments it may be desirable to employ polymer hydrogels exhibiting reversible phase transition behavior. These types of polymers can be designed to react to a number of stimuli. The specific stimulus to which they react is determined primarily by the constituent elements of the gel. The range of stimuli includes temperature, stress, magnetic field intensity, pH, chemical concentrations and light intensity, while the reactions include changes in volume, stiffness, color and viscosity. Which stimulus and which reactions are obtained depend on the type of chemical interactions between the polymer molecules and the fluid. In reversible hydrogels, one of the most commonly used and applicable stimuli is thermal, coupled to a volume phase transition.

The property of gels in powder form that is particularly useful in the present invention is their ability to block flow. Gels in powder form, when dry, will allow the passage of air and water in spaces that exist between the packed particles, provided the particles are of sufficient size to produce spaces. When the surface of this powder mass is brought into contact with a fluid medium such as water, the particles at the surface begin to absorb fluid, swell and soften. If the motion of the gels is somewhat restrained by preventing an overall change in volume, the swelling particles have no choice but to fill in the empty spaces between the particles, effectively sealing off the flow path. As long as fluid medium is present, the gel will tend to swell to regain a condition of equilibrium, which will ensure that the seal is maintained. Over time, water will diffuse through the network, but through design it is possible to significantly slow down this process. For example, water will diffuse through dry gel at a rate that is four orders of magnitude slower than through wet gel. Therefore, by maintaining a dry core in the sealing mechanism, it is possible to make the seal substantially impermeable.

According to the present invention, fast swelling superabsorbent polymers are used in the creation of a sealing device that is activated by the presence of water, either fresh water or salt water with a sodium ion concentration ranging from about 0 to 10%. This sealing device is particularly useful in applications such as a body suit, where it functions as a safety device in the form of a neck seal, wrist seals, or ankle seals installed in body suits, such as survival suits and dry suits, particularly of the type used by marine aviators.

In one application, the use of a water-activated mechanism for securing a watertight seal enables the design of a neck seal that is somewhat loose fitting under normal working conditions, but that will autonomously tighten, within about 10 to 15 seconds, to provide sealing pressure, whether against an initially loose fitting membrane or directly on the user's neck. One advantage of this approach is that in emergency situations, when the user may be unconscious, the device will function properly because user intervention is not required for activation. Another advantage of sealing devices according to the present invention is that by using what is essentially water trapped in a polymer matrix to inflate the seal, damage sustained in a crash, such as punctures in the sealing devices, would not substantially affect operation of the seal.

A sealing device according to the present invention preferably includes one or more of a sealing element, an actuating element, and a force directing element. The sealing and actuating elements may be integral or separate. In an integral configuration, the swelling action of the polymer (actuating element) applies sealing pressure to the neck and compresses the polymer housed in the sealing element so as to shut off leak paths through the sealing device. This configuration allows air to flow through the sealing device when it is dry. Ideally, to minimize the amount of water allowed into the sealing device at the moment of immersion, the initial space between the neck and the sealing device must be minimized. In a configuration with separate sealing and actuating elements, however, the swelling action of the polymer would instead be solely responsible for the provision of sealing pressure.

The actual sealing function is carried out by a sealing element having a very thin, flexible membrane made of an elastic material, such as neoprene or Lycra, which is pressurized by the polymer actuating element to close tightly around the neck. The thin membrane, preferably sized with a diameter approximately equal to the wearer's neck, fits in close contact with the skin but does not stretch substantially enough to cause any uncomfortable constriction. The thin membrane stretches sufficiently to ensure that there are no folds in the elastic material making up the thin membrane. Sized in this way, the sealing element still allows some air flow, although not to the extent of a sealing element that is gas permeable when dry.

In order to direct the force of swelling of the actuating element toward the neck, it is necessary to provide a non-stretch external element, referred to herein as a stiffener. Without such a stiffener a large portion of the force exerted by the swelling polymer would go to stretching the sealing element. Because the stiffener must be made of a non-stretch material that is highly permeable to ensure water access to the polymer actuating element, the stiffener preferably is separate from the sealing element, i.e., the stiffener and sealing element are not made of a continuous piece of fabric. The stiffener preferably is adjustable to a range of neck sizes and is fixed at a single point along the circumference of the neck. When the neck seal is worn and the elastic material of the sealing element adapts to the neck size, the non-stretch stiffener can close and adapt to the size of the neck. In the case of integral sealing and actuating elements, the stiffener is simply a fabric flap, whereas in the case of separate sealing and actuating elements, the actuator strip is attached to the stiffener so that the stiffener can conform to the size of the neck.

Figure 2:
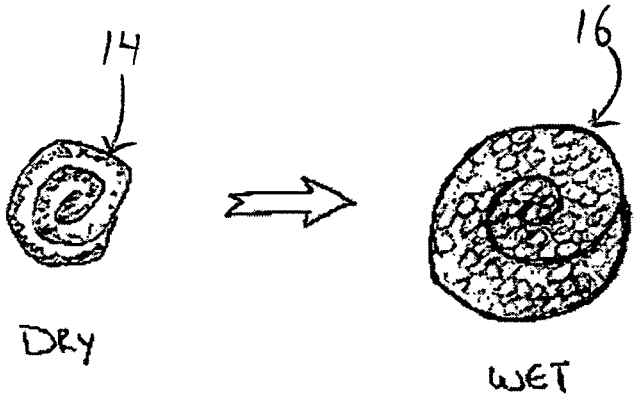
FIG. 2 is a schematic view in cross-section of the toroid seals of FIG. 1 shown in dry and wet states.

According to the present invention, the integral sealing and actuating elements can be manufactured by a simple method of containing the polymer actuating element in the sealing element that allows for expansion of the sealing element while compressing the enclosed actuating material. One solution is a spiral section element, an example of which is depicted in FIGS. 1 and 2. As shown in FIG. 1, the spiral section element is constructed by loosely rolling a strip 10 of suitable stretch material, such as a very light Lycra material (such as that commonly used in the manufacture of women's pantyhose). A single layer of polymer powder 12 can be bonded to the strip 10, but additional layers of polymer can also be included. As shown in FIG. 1, the strip 10 is rolled along its length to form a tube 14 with a loose spiral section, which is largely empty inside. The space inside the fabric spiral is important to the function of the spiral section element in this application, as this space allows for the quick transport of water to ensure that all the material inside the spiral is wet, resulting in a very fast swelling seal. As shown in FIG. 2, once swollen, the tube is completely filled by swollen polymer (see reference numeral 16), which enables the spiral section element to exert the required sealing pressure.

A tube or spiral according to FIGS. 1 and 2 that contain exclusively the fast swelling polymer can generate the fastest swelling speed, but by blending different types of polymers that swell at different speeds it is possible to maintain the core of the tube dry. This prevents the diffusion of water through the spiral section element and makes it impermeable. The contents of the tube 14 may, therefore, be tailored to whether the required action is purely actuation, sealing, or both. This approach results in a manufacturing process that is very simple and requires only a few steps. For example, by using a tubular stretch fabric placed over a form, it is possible to manufacture a toroidal seal with a spiral section having no joints. Alternatively, the tube can be formed by joining two ends of a fabric strip with a stretchable stitch. The stretch stitch can assist in preventing a bottleneck from forming at the joint site upon swelling, which removes a potential leak path associated with butt joints that require accurate alignment. One possible modification during the manufacturing process is to coat the inner surface of the seal ring, which is in direct contact with the wearer's neck, with a rubberizing material that will improve sealing by preventing the fabric between the polymer and the neck from wicking water into the body suit.

Figure 3:
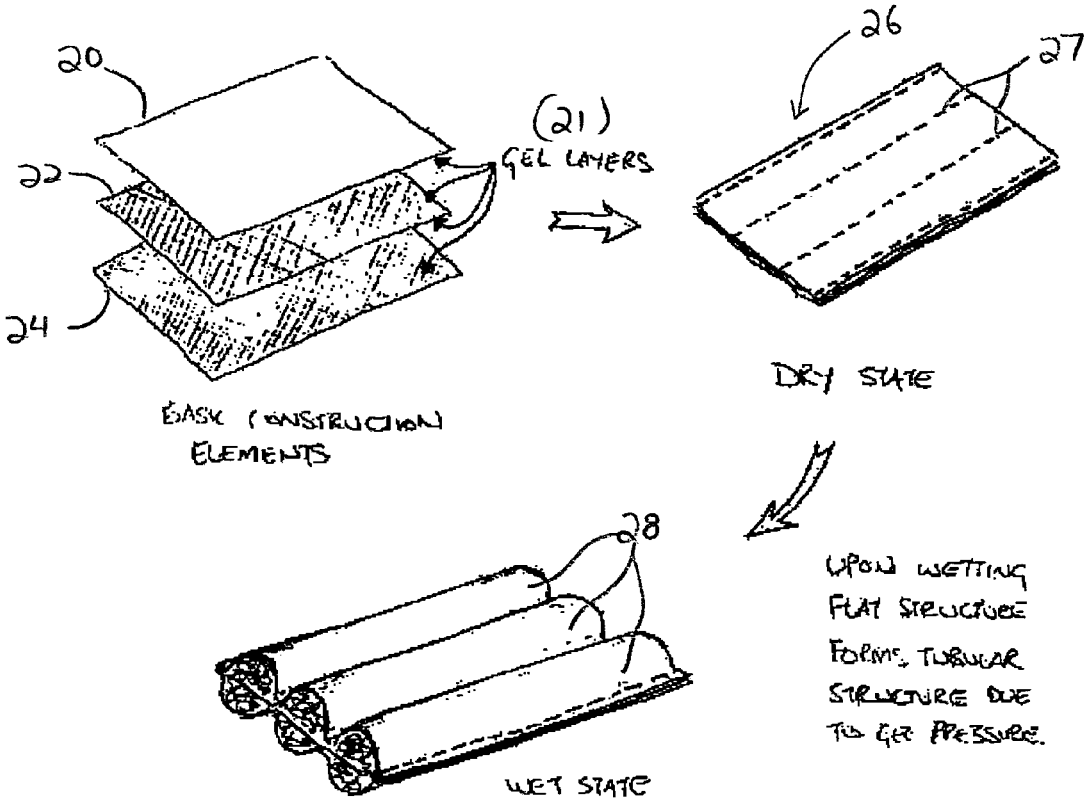
FIG. 3 is a schematic view of a gel actuator pack useful in a sealing device of the present invention.

FIG. 3 depicts an actuating element in the form of a gel actuator pack, preferably for use in embodiments having separate sealing and actuating elements. As shown in FIG. 3, a plurality of strips, e.g., three strips 20, 22, and 24 of a suitable permeable stretch fabric, such as Lycra, are stitched together along stitch lines 27 to form the gel actuator pack 26. The outer layers 20 and 24 preferably each have a single layer of polymer powder 21 bonded on inside facing surfaces of the gel actuator pack 26, while the middle layer 22 has polymer powder bonded to both its surfaces. As a result, the gel actuator pack 26 contains at least four layers of polymer powder 21, although any number of polymer layers can be used. At least one stitch line 27 is formed along each edge of the gel actuator pack 26, and two or more stitch lines 27 preferably are equally spaced across the width of the gel actuator pack 26. These stitches produce equal width boundaries across the gel actuator pack, which upon being swollen forms a plurality of tubes 28 and is able to exert pressure on the outer layers 20 and 24 which form a sealing membrane.

The gel actuator pack 26 is designed for use with a separate sealing element (not shown), e.g., a thin, stretchable neoprene membrane. One or more strips of the hook part of any suitable hook and loop fabric may also be sewn onto the gel actuator pack to provide a mechanism for holding the gel actuator pack onto a stiffener. The gel actuator pack of FIG. 3 is especially suited for applications which call for adjustable sealing devices that do not require the tight fit delivered by integral actuating and sealing elements such as the toroid seals of FIGS. 1 and 2.

One consideration in the alternative designs described with reference to FIGS. 1 and 2, and FIG. 3, respectively, is containment of the polymer. Preferably the polymer is bonded with a thin layer of water soluble adhesive. This approach can be used to bond a single layer, as well as to build up multiple layers of polymer on a single fabric strip. The advantage of this method is that the adhesive dissolves when the seal is wet, and as the polymer swells it can shift and redistribute pressure that may be applied unevenly. In a sealing device having integral actuating and sealing elements, this shifting of the polymer may be undesirable because over time the polymer may migrate and be distributed unevenly in its dry state, making the transition to swollen wet state of the seal less effective. This may also be observed with the actuator gel pack design after prolonged use. In this case, an alternative to water soluble adhesives is to join the polymer to the fabric substrate by gamma ray irradiation, although this may not be suitable for all material combinations. It is preferable to use an adhesive in the design of a gel actuator pack such as depicted in FIG. 3, because the gel actuator pack is designed to be a cheap, discardable item. The use of a disposable actuator pack facilitates the maintenance and laundering of the body suit, and can easily be replaced in the event of accidental activation of the seal. Furthermore, it also solves the problem associated with degradation of the swelling properties of the gel over time as sodium ions are gradually absorbed into the polymer matrix. A discardable actuator would eliminate the need for complete seal replacement.

Another consideration to be addressed in any design configuration is the requirement of limiting the pressure exerted on the neck upon activation of the sealing device, and this can be done in a number of ways. One approach is to limit the amount of polymer (actuating element) contained in the sealing elements so that when fully swollen they reach a maximum bloat. A drawback to this approach: if the swelling element is adjustable by the user for accommodating different neck sizes, e.g., designs using a gel actuator pack, it is possible that the loosest setting would render the maximum swelling insufficient to generate enough sealing pressure. Another drawback reflects a property of the polymer actuating elements: since the maximum swelling is influenced by sodium ion concentration, cases may occur where the combination of fit and salinity result in less than adequate swelling. Therefore, the degree of swelling of the polymer and the intended use environment must be considered for a given application. Another approach for controlling the exerted pressure is to make use of a fabric with limited stretch for containment. In this case sufficient polymer can be contained to ensure that the actuator always reaches maximum swell at a predetermined size. The drawback is that reliability depends on the user's initial setting of the device. A further approach for controlling the pressure is to introduce elastic elements into the stiffener that limit the maximum pressure exerted on the neck by allowing the stiffener to stretch when the hoop stress generated by the swelling polymer reaches a predetermined level. This method too could be dependent on the user's initial setting, but since the pressure limit is built into the structure, protection against loose settings is made by ensuring that there is enough swell in any condition. Yet another approach involves altering the polymer itself to limit swell under pressure by manipulating the properties that influence osmotic pressure, such as ionization level. By following any of the above approaches, it is possible to restrict the amount of pressure exerted on the neck upon activation of the sealing device, based on the requirements for a particular application.

As described above, two distinct design approaches are possible by using the superabsorbent polymers either as simple actuating elements (FIG. 3), or as both actuating and sealing elements (FIGS. 1 and 2). For example, in the modular gel actuator pack described with reference to FIG. 3, sealing is accomplished by an impermeable membrane in initial contact with the skin to provide a loose fitting initial barrier and check valve mechanism for airflow. The sealing pressure is then provided by the gel actuator pack, which is designed to be a removable, disposable element. This approach lends itself well to utilizing a fairly coarse distribution of gel particles for maximum swelling and speed and addresses the issue of gel permeability over extended time periods. Alternatively, in the design of a toroid seal, as depicted in FIGS. 1 and 2, the sealing and actuating elements are provided directly by the contained gel structure, which is stiffened by an external, integral stiffener. This design would lend itself well to both the turtleneck and open neck approaches. Embodiments of sealing devices constructed based on these alternative design approaches are now discussed.

Figure 4:
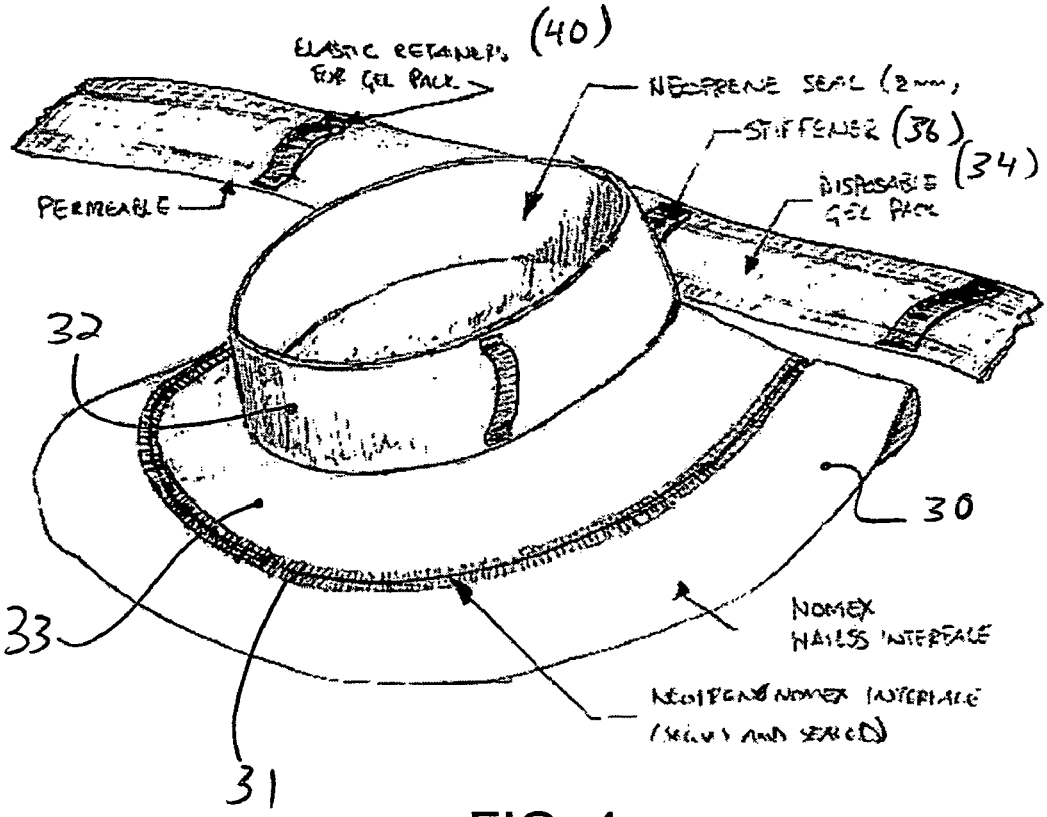
FIG. 4 is a front perspective view of a body suit with a neck seal incorporating a gel pack actuator according to a first preferred embodiment of the present invention.

FIGS. 4 through 9 illustrate a body suit with a neck seal according to a first preferred embodiment of the present invention, the neck seal incorporating a gel actuator pack, e.g., of the type described with reference to FIG. 3. As shown in FIG. 4, a sealing device of the invention includes a neoprene primary seal 32 (sealing element) and a gel actuator pack 34 (actuating element). Although neoprene is a preferred material for the primary seal 32, other materials can be used, such as latex, silicone rubber or rubber coated fabric. Any flexible impermeable material would be suitable, and falls within the scope of the present invention. The gel actuator pack 34 preferably is removable and disposable, and is configured to be wrapped around the neoprene seal 32.

A gel actuator pack suitable for use with the first preferred embodiment of FIGS. 4-9 preferably is constructed in the manner described above with reference to FIG. 3. In other words, the gel actuator pack 34 can include a plurality of layers of stretch fabric with one or more layers of polymer powder bonded to each layer of stretch fabric. The polymer powder preferably is a superabsorbent hydrogel, such as a base sodium polyacrylate modified with poly-anionic beads, as described herein. For example, in one particular application, the polymer activates in the presence of fresh or salt water having a sodium ion concentration ranging from about 0 to 10%, where the neoprene seal 32 tightens within about 10 to 15 seconds after exposure to the fresh or salt water. The superabsorbent hydrogel can be reversible, or can display reversible phase transition properties. Hydrogels other than sodium polyacrylate are acceptable, depending on the specific requirements for a given application, such as speed of activation and degree of swelling.

As shown in FIG. 4, the body suit 30 can be made of Nomex, neoprene, or any suitable material having properties that are selected based on the environment and intended use of the body suit. The body suit 30 preferably includes the neoprene seal 32 arranged in the neck area, and optionally can include a transitional area 33 made of neoprene or like material. The neoprene seal 32 is fitted according to the size of the wearer's neck, and can be either a continuous extension of the body suit 30 and/or transitional area 33, or a separate element that is stitched or woven to the body suit 30, or otherwise attached to the body suit 30, e.g., according to methods well known in the art.

Figure 5:
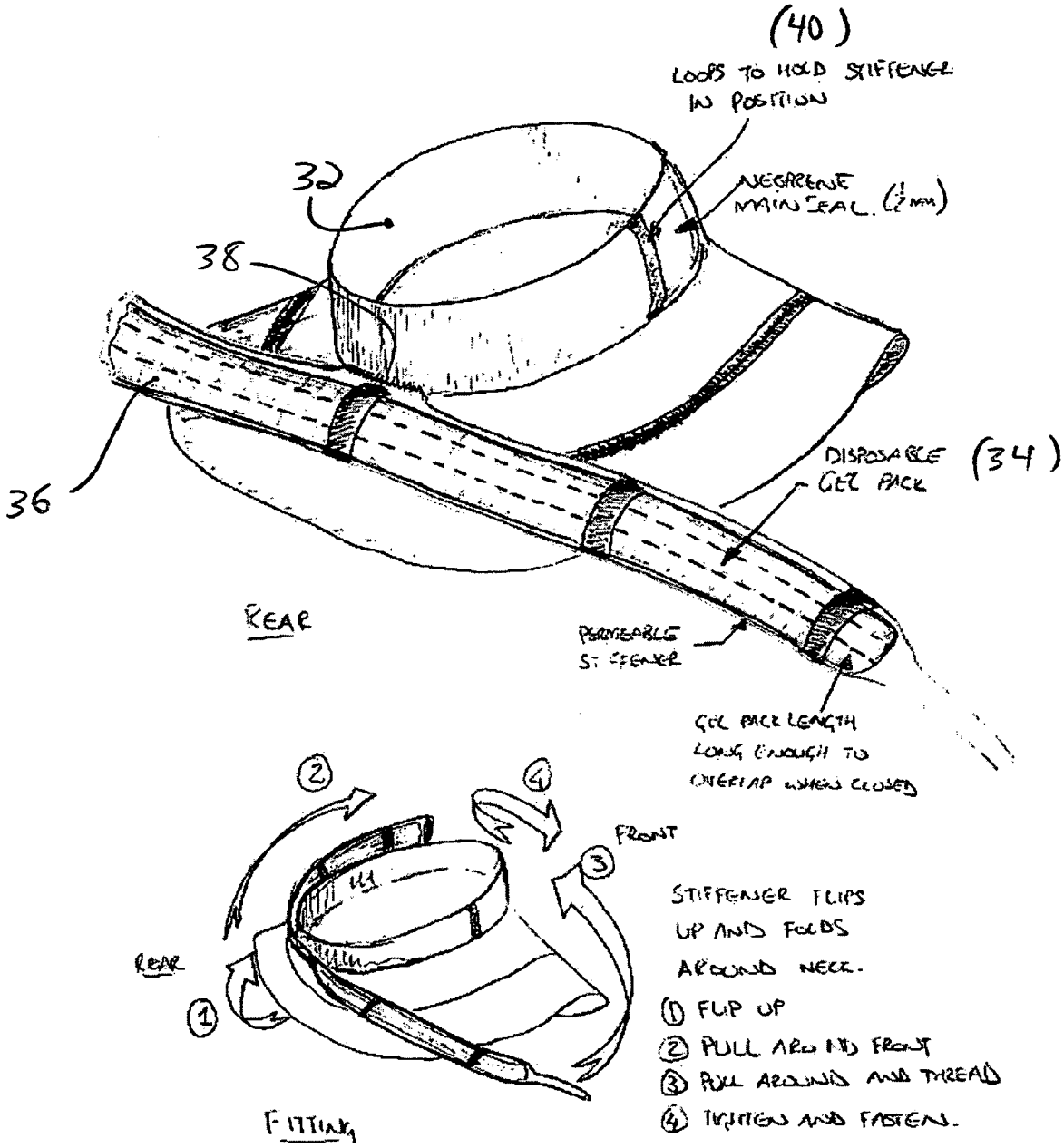
FIG. 5 is a rear perspective view of the body suit and neck seal of FIG. 4, and a schematic view of a method for securing the neck seal around the neck area.

As shown in FIG. 5, the gel actuator pack 34 is attached to the neoprene seal 32 at a fixed point of attachment 38 preferably at or near the back of the neck, although the gel actuator pack 34 can be attached at other locations along the neoprene seal 32. The preferred single point of attachment allows the size of the stiffener 38 to be easily adjustable to cover a range of neck sizes. Therefore, a single size of stiffener, or a limited range of sizes, preferably can accommodate most wearers. The gel actuator pack can be attached to the stiffener in any suitable way, along the length of the stiffener.

Figure 6:
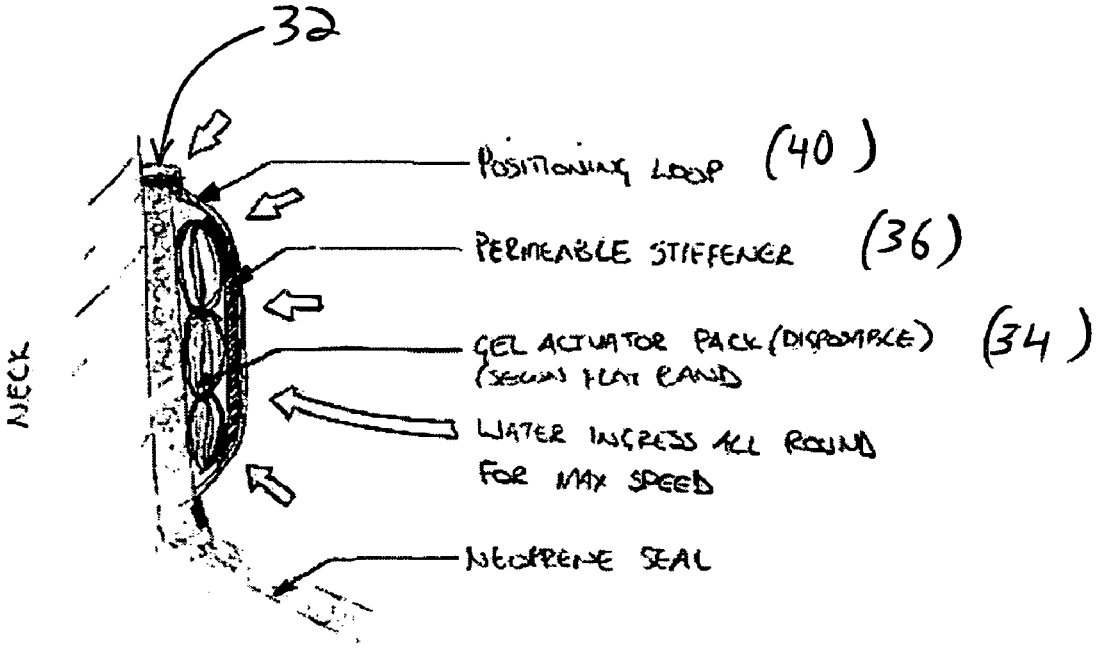
FIG. 6 is a cross-sectional side view of the neck seal of FIGS. 4 and 5 against a wearer's neck.
Figure 7:
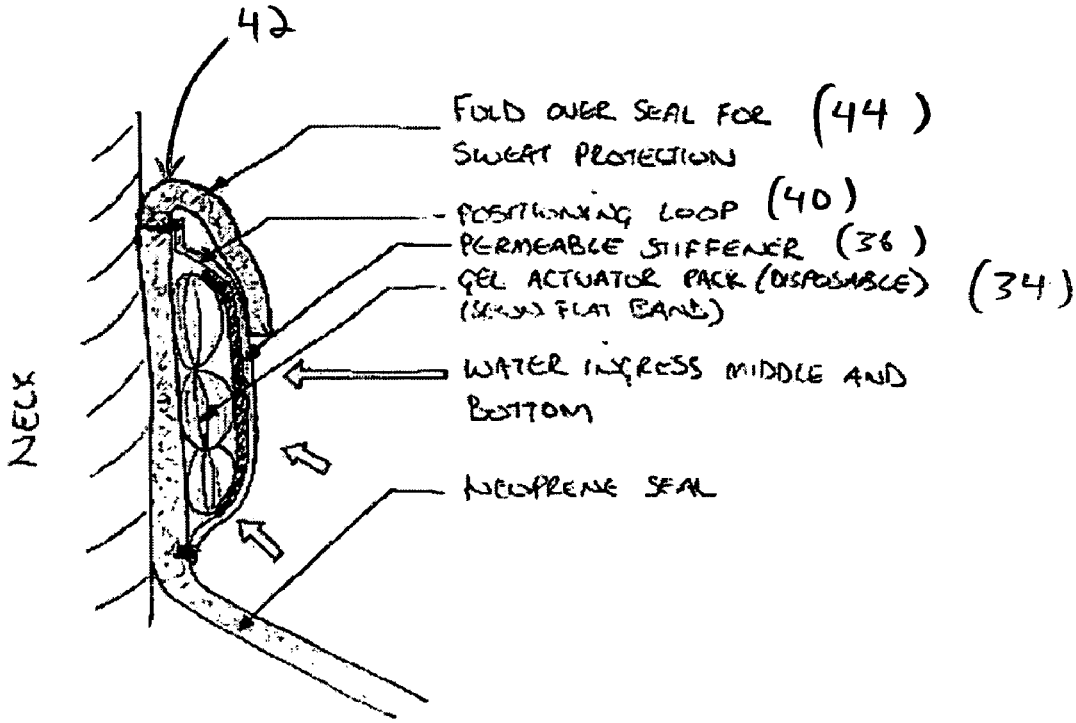
FIG. 7 is a cross-sectional side view of an alternate neck seal with a fold-over flap.

The sealing device will be described in greater detail with reference to FIGS. 6 and 7. As shown in FIG. 6, a stiffener 36 preferably is disposed adjacent the gel actuator pack 34, the stiffener being made of any permeable, non-stretch material. The stiffener 36 preferably is in direct contact with the gel actuator pack 34, and can be attached thereto by any of a number of attachment mechanisms. One such attachment mechanism is depicted in FIGS. 5 and 6, where the sealing device includes a plurality of optional positioning loops 40 for holding the gel actuator pack 34 and stiffener 36 adjacent the neoprene seal 32. The positioning loops 40 extend across the width of the gel actuator pack and stiffener, and can be attached to the neoprene seal 32 at either end, thereby forming a plurality of hook and loop strips. The stiffener 36 can be threaded through the loops 40, or held by another appropriate mechanism, to ensure proper positioning. Alternative attachment mechanisms include snap buttons running along the length of the sealing device, a stiffener formed with a pocket along its length to receive the gel actuator pack, a set of loops placed on the stiffener to hold the actuator, and one or more hook and loop strips or tabs placed in the center along the length of the stiffener and actuator.

In the sealing device shown in FIG. 6, the neoprene seal 32 rests flat against the neck of the wearer, and the neoprene seal 32 is contacted by the gel pack actuator 34 and stiffener 36, which are retained by positioning loops 40. Alternatively, instead of loops, a number of hook and loop patches can be used, or the stiffener that carries the gel pack can be ergonomically designed and shaped to follow the contours of the neck so as to not require specific means of holding it in place. In this sealing device, water ingress is permitted all around the stiffener 36, which maximizes the speed of activation of the gel actuator pack. FIG. 7 depicts an alternate sealing device in which the neoprene seal 42 includes a fold-over flap 44, the flap 44 being designed to cover at least a top portion of the stiffener 36, thereby restricting water ingress in the covered portion. By including the fold-over flap 44, the neoprene seal 42 has been modified to externally deflect sweat from the active parts of the neoprene seal 42 and avoid possible premature activation.

Figure 8:
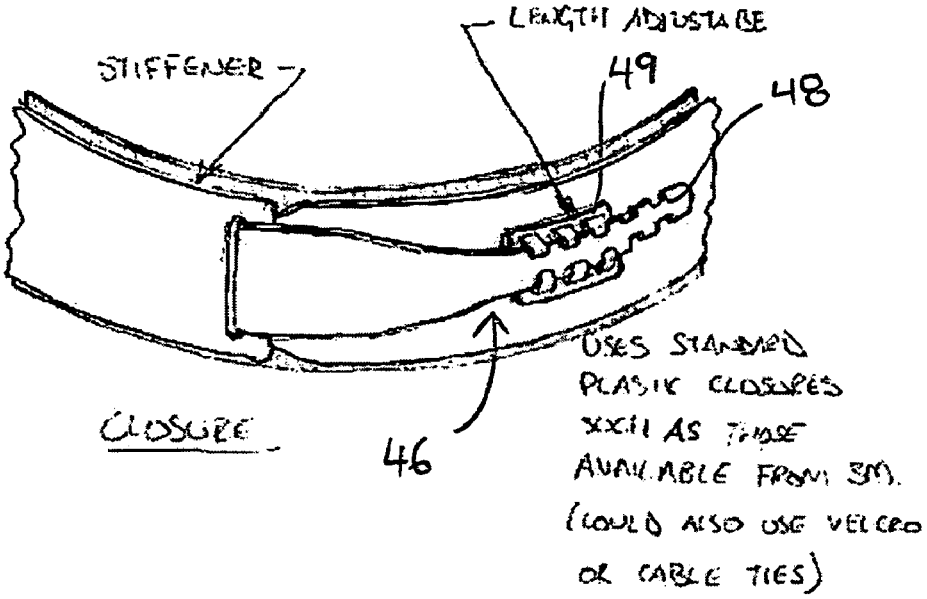
FIG. 8 is a front perspective view of a closure for the neck seal of FIGS. 4 and 5.
Figure 9:
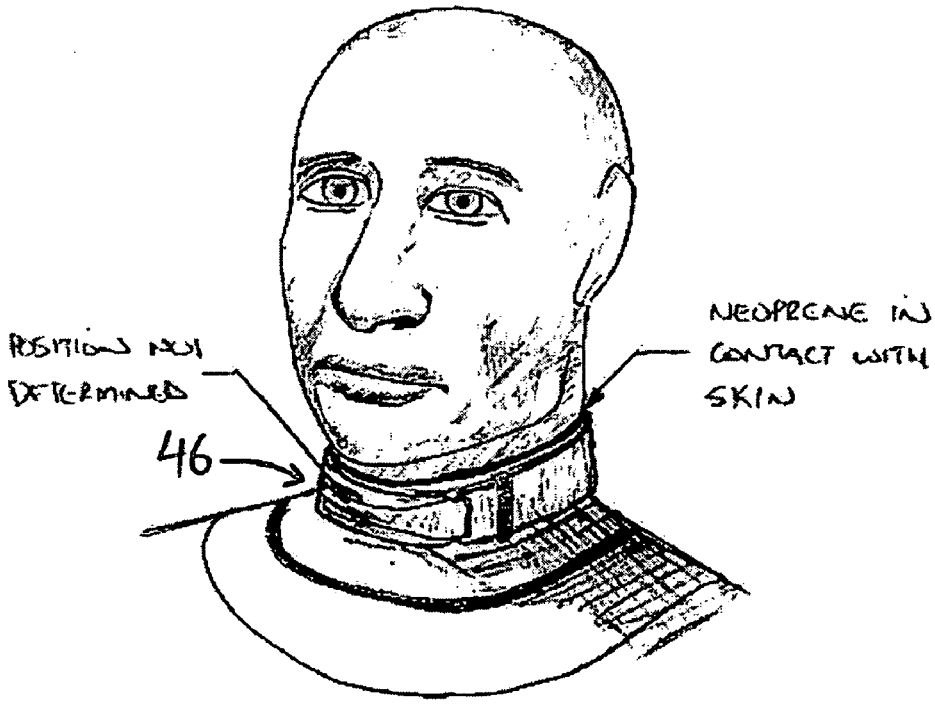
FIG. 9 is a perspective view of the neck seal of FIG. 8 closed around the neck of a wearer.

FIG. 8 illustrates a stiffener closure 46 according to the present invention. A number of known closure mechanisms can be used for the stiffener closure 46, where FIG. 8 depicts a simple snap style closure, including a notched part 48 having a plurality of length settings, and one or more teeth 49 for receiving the notched part 48. The closures can be made from commercially available, interlocking plastic parts. Another example of a suitable closure mechanism is one made from Velcro hook and loop fabric. A further example is a commonly available product that relies on the mechanical interference of multiple mushroom-headed pins, which can provide a high load carrying capacity. Any of the above closure mechanisms can be sewn into the fabric of the stiffener 36, ultrasonically welded to the stiffener, or otherwise attached to it.

To operate the sealing device, the wearer puts on the body suit such that the neoprene seal 32 passes over the wearer's head, coming to rest around the wearer's neck. In this initial configuration, the sealing device is not yet deployed, instead resting in a loose and comfortable manner around the wearer's neck. Preferably the neoprene seal 32 is somewhat loose fitting under normal working conditions but in close proximity of the wearer's skin. To deploy the sealing device, as shown in FIG. 5, the stiffener 36 is flipped up around the point of attachment 38 and folded around the wearer's neck. Then, the end of the stiffener having the teeth 49 of the stiffener closure 46 is pulled around toward the front of the neck, and the other end of the stiffener is pulled around with the notched part 48 being threaded through the teeth 49. The snap style closure, or other closure mechanism, is then tightened and fastened, thereby deploying the sealing device in the configuration depicted in FIG. 9. When the sealing device is submerged in fresh water or salt water, the gel actuator pack 34 will activate in a predetermined amount of time, e.g., about 10 to 15 seconds, causing the stiffener 36 to tighten around the neoprene seal 32, thereby applying sealing pressure against the wearer's neck. As a result, during emergency conditions in which the user may be unconscious, the sealing device will function properly because no user intervention is required for activation of the gel actuator pack of the neck seal.

Figure 10:
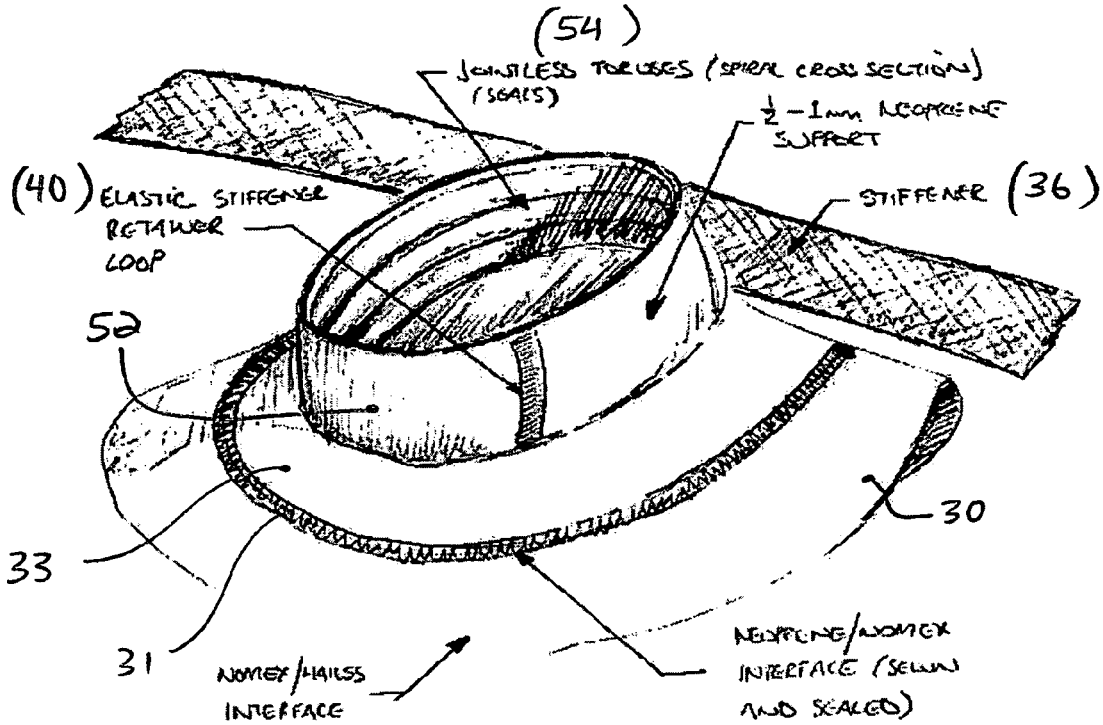
FIG. 10 is a front perspective view of a body suit with a neck seal incorporating toroid seals according to a second preferred embodiment of the present invention.
Figure 11:
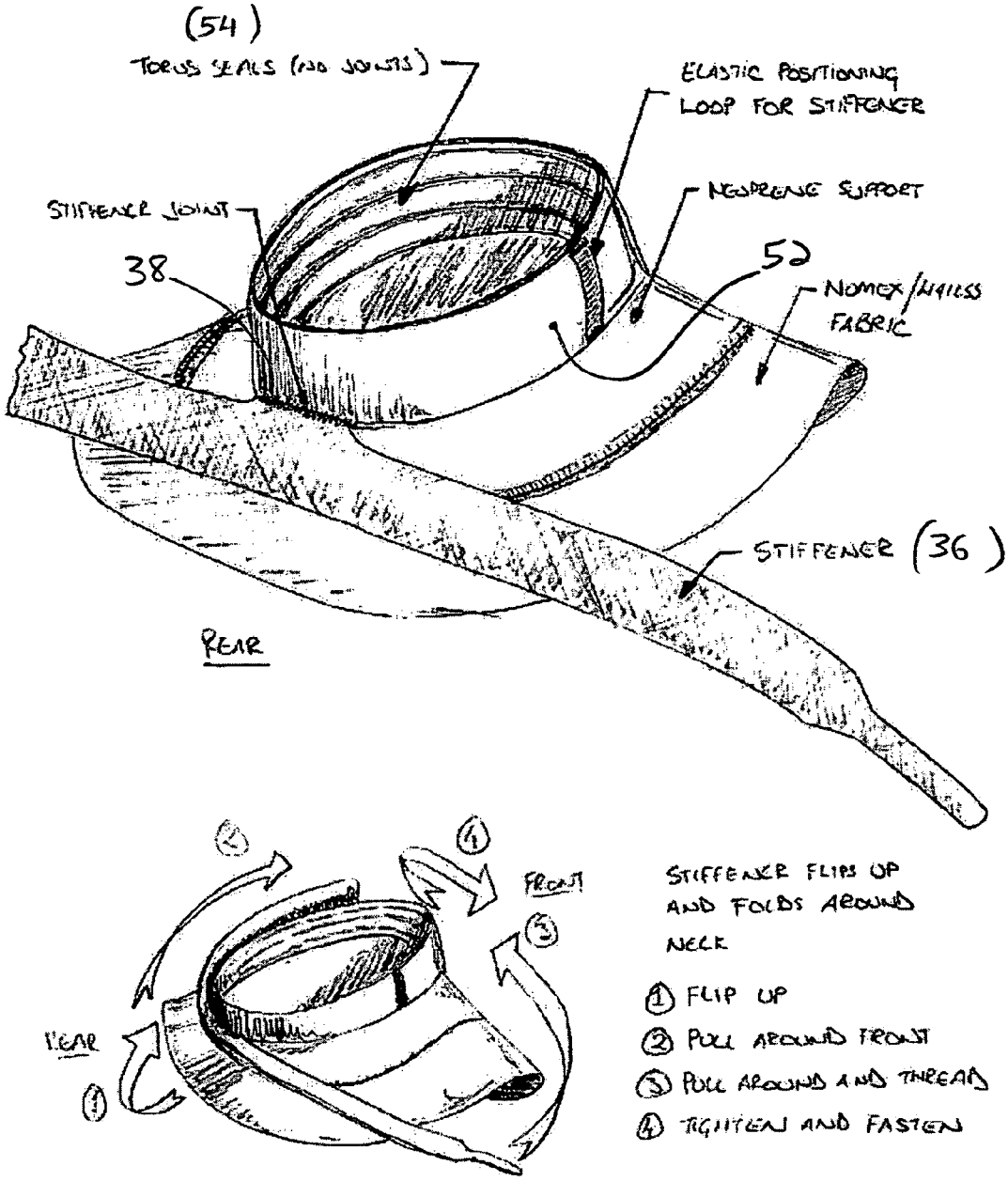
FIG. 11 is a rear perspective view of the body suit and neck seal of FIG. 10, and a schematic view of a method for securing the neck seal around the neck area.

FIGS. 10 through 13 illustrate a body suit with a neck seal according to a second preferred embodiment of the present invention, the neck seal incorporating multiple toroid rings containing gel, e.g., of the type described with reference to FIGS. 1 and 2. As shown in FIG. 10, a sealing device according to the second preferred embodiment is turtleneck-shaped as in the first preferred embodiment of FIGS. 4-9, but the gel actuator pack of the first preferred embodiment has been replaced by a combined sealing element and actuating element in the form of one or more toroid rings (i.e., torus seals, or toruses) 54.

Figure 13:
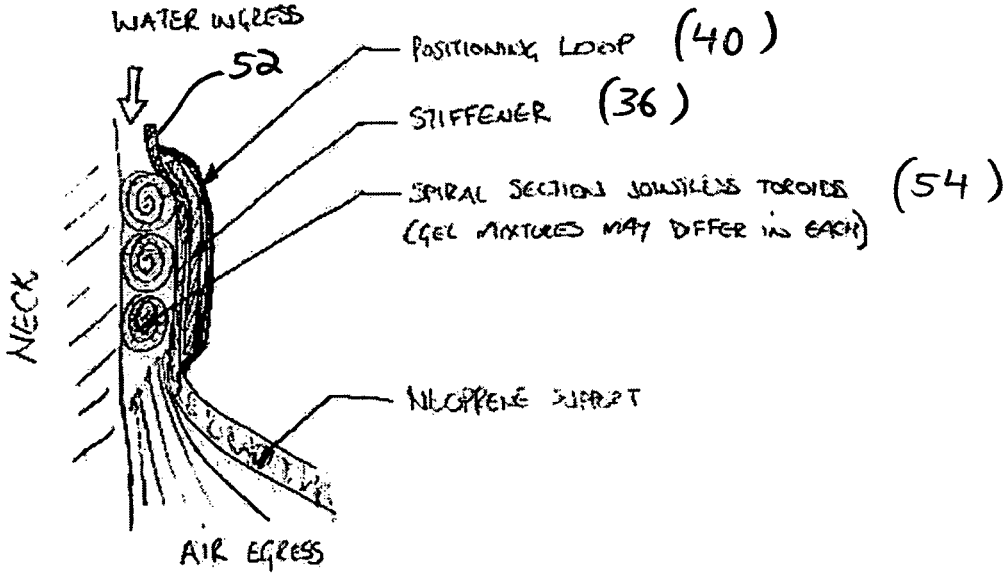
FIG. 13 is a cross-sectional side view of the neck seal of FIGS. 10 and 11 against a wearer's neck.
Figure 14:
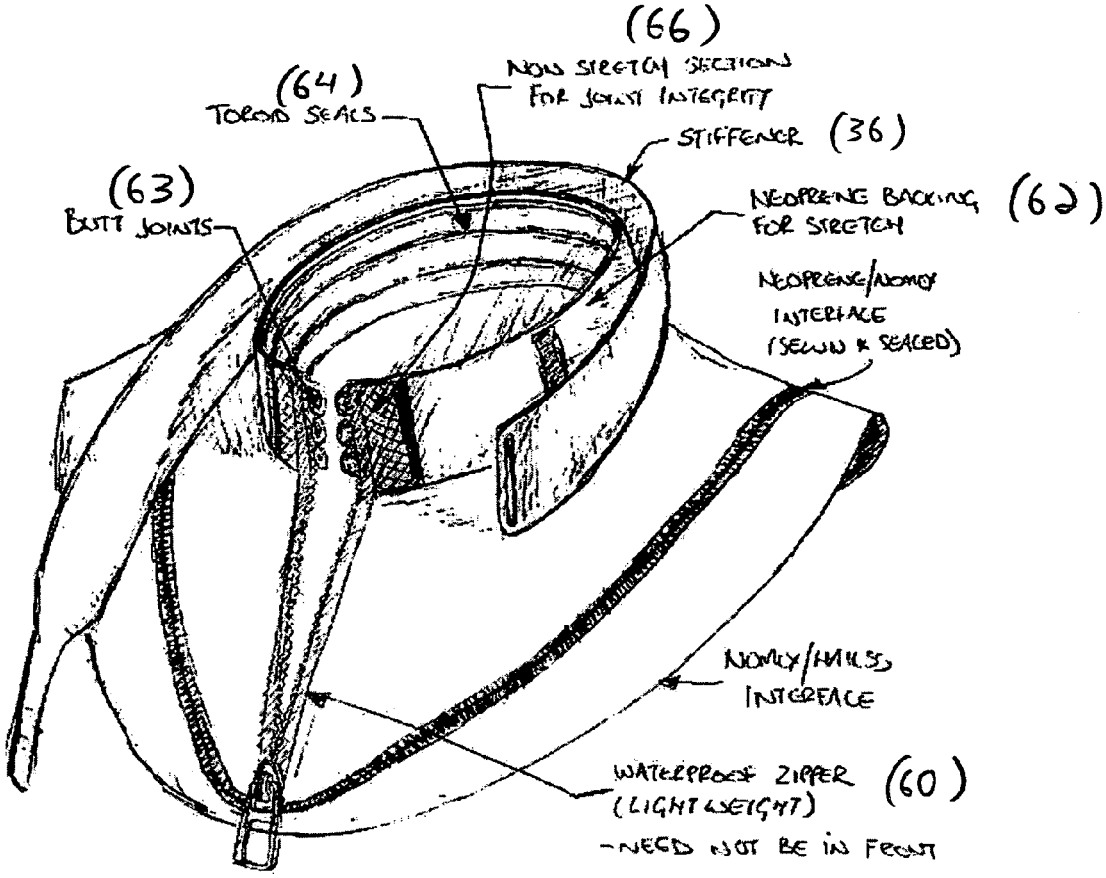
FIG. 14 is a front perspective view of a zippered body suit with a neck seal incorporating gel toroids according to a third preferred embodiment of the present invention.
Figure 15:
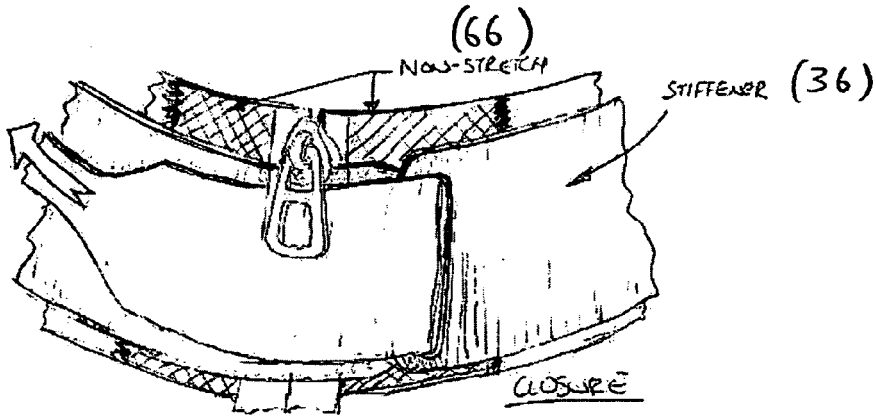
FIG. 15 is an exterior front perspective view of a closure for the neck seal of FIG. 14.
Figure 16:
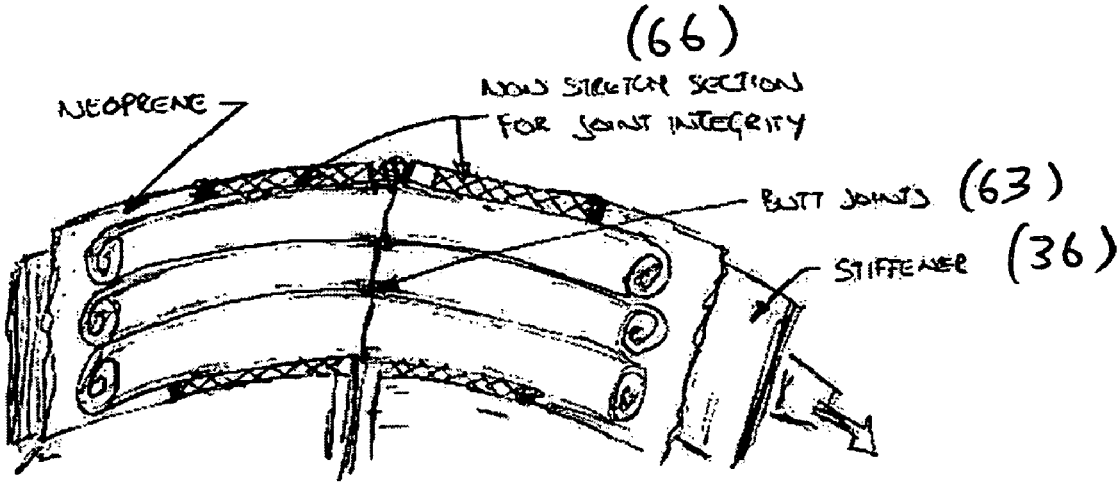
FIG. 16 is an interior view of the closure of FIG. 15.

In the second preferred embodiment, the toroid rings 54 are arranged inside a neoprene seal (sealing element) 52 such that the toroid rings 54 are in direct contact with the skin of the wearer's neck. This direct contact between the toroid rings 54 and the neck allows better airflow through the neck area because the toroid rings 54 are formed with permeable membranes, as opposed to the impermeable membrane of the neoprene seal 52. As shown in FIG. 13, air egress occurs from inside the body suit through the area between the toroid rings 54 and the wearer's neck, and water ingress occurs in this area from outside the body suit. The neoprene seal 52 can be made of neoprene or any suitable stretch material, e.g., super stretch 1 mm neoprene, to ensure sufficient stretching for easy donning and doffing, and can be manufactured in a limited range of sizes.

As described above, the toroid rings each are formed from a spiral section element in which one or more layers of polymer powder, preferably a single layer, is bonded to a strip of suitable stretch fabric, which is rolled along its length to form a tube with a loose spiral section (see discussion above with reference to FIGS. 1 and 2). The toroid rings preferably are manufactured using tubular fabrics without joints. As shown in FIGS. 10-13, the toroid rings 54 are placed in direct contact with the skin in the wearer's neck area. Although three such toroid rings 54 are depicted in FIG. 13, one or more toroid rings can be used in the present invention.

Figure 12:
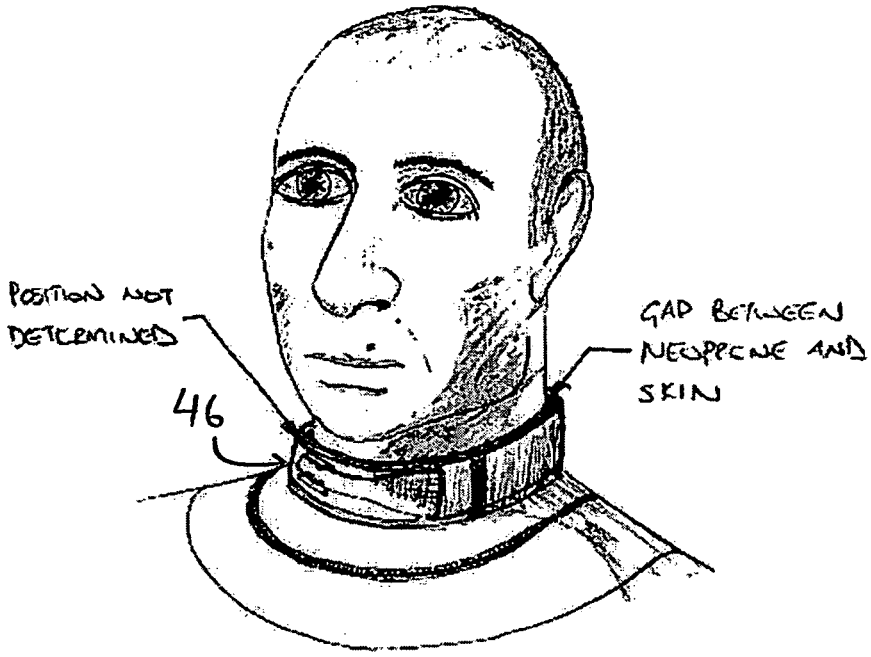
FIG. 12 is a perspective view of the neck seal of FIGS. 10 and 11 closed around the neck of a wearer.

To operate the sealing device, a stiffener 36 of the type previously described is flipped up at the point of attachment 38, with the ends pulled around the wearer's neck and fastened together using the stiffener closure 46 (see FIG. 12). In the second preferred embodiment of FIGS. 10-13, the stiffener 36 is threaded through positioning loops 40 and brought into direct engagement with the neoprene seal 52. The use of loops is optional, where the attachment method depends on design choice, with it being clear to anyone skilled in the art that various solutions can be chosen depending on the intended use and requirements for the neck seal.

The above-described first and second preferred embodiments incorporate continuous seals that require the sealing element to be stretched over the wearer's head during donning and doffing. Although the use of a very thin sealing membrane or stretchable seals for the sealing element allow for easy operation, it is possible to further facilitate donning and doffing by including a zipper. The use of a zipper allows the seal to be opened easily. Because the seals are split, the zipper must be made somewhat stiff but still retain adequate flexibility; currently available waterproof zippers satisfy these criteria.

FIGS. 14-19 illustrate a body suit with a neck seal according to a third preferred embodiment of the present invention, the neck seal incorporating multiple toroid rings 64 containing gel in contact with the skin, the toroid rings 64 having split surfaces to accommodate a waterproof zipper 60. The split surfaces preferably are formed with a cap to retain any polymer powder that may come loose during handling, where butt joints 63 can form the cap. The butt joints 63 should be capable of stretching with the rest of the toroid rings 64 so as not to produce a constriction that will lead to a leak path. The zipper 60 is installed so that it pulls the butting ends of the joints 63 together on closure. To ensure that the positional relationship between the butting ends is maintained, the seal area immediately next to the zipper preferably is made of non-stretch material 66.

A preferred installation of the zipper 60 is such that it runs along a diagonal line beginning at the center of the breastbone and extending along the line of intersection of the neck with the torso, on either side, thereby improving neck mobility. A zipper arranged in this manner does not interfere with forward and backward movement of the head, with rotation of the head, or with sideways tilting of the head because the zipper is located in a fold between the neck and torso. Moreover, a slanted zipper that runs along the side of the neck in a mostly horizontal direction would provide a larger opening and superior mobility and comfort. However, the zipper can be placed anywhere and in any orientation, with corresponding butt joints provided on both ends of the toroid rings. A body suit according to the third preferred embodiment, even though it includes a zipper, is also able to accommodate a range of neck sizes. The basic seal construction is identical to the continuous seal design of the second preferred embodiment, i.e., having a plurality of toroids 64 supported on a stretchable neoprene backing (neoprene seal 62). Once the lightweight waterproof zipper 60 is closed, seal integrity is maintained. As in the previous designs, the neck seal is supported by a flexible, non-stretch stiffener 36. The stiffener design is identical to that of the previous designs and includes a closure 46 to ensure adjustability. Because the body suit includes the zipper 60, this sealing device is easier to don and doff than others.

Figure 17:
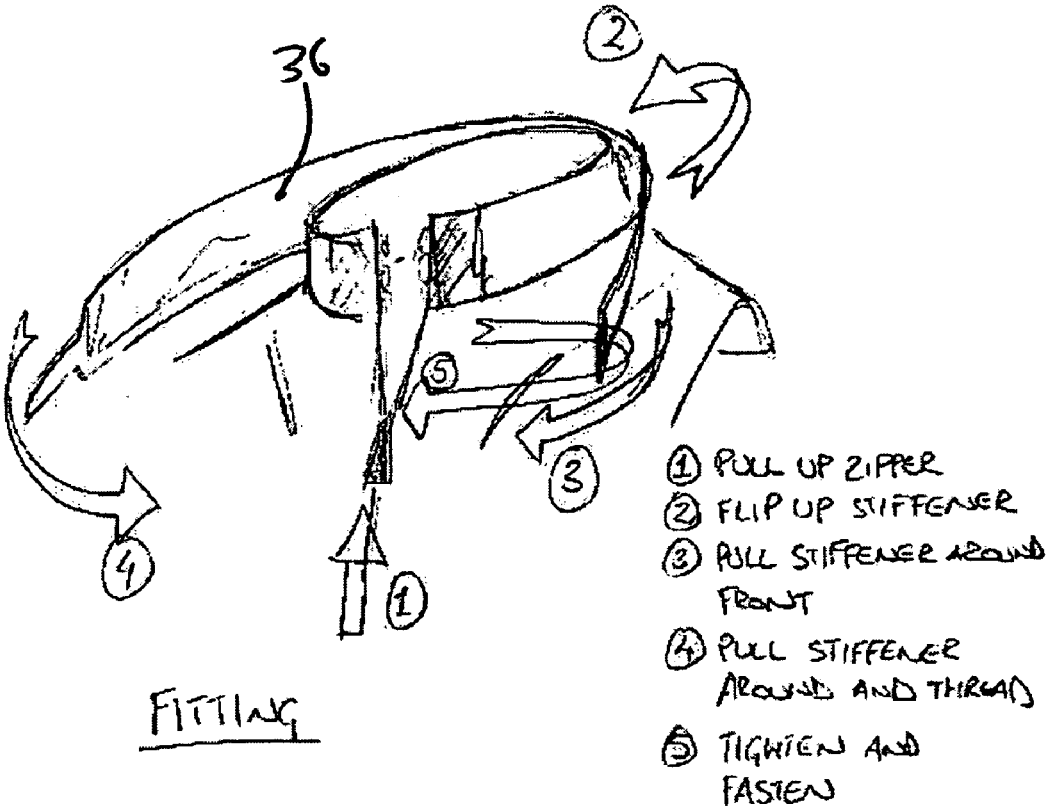
FIG. 17 is a schematic view of a method for securing the neck seal of FIG. 15 around the neck area.
Figure 18:
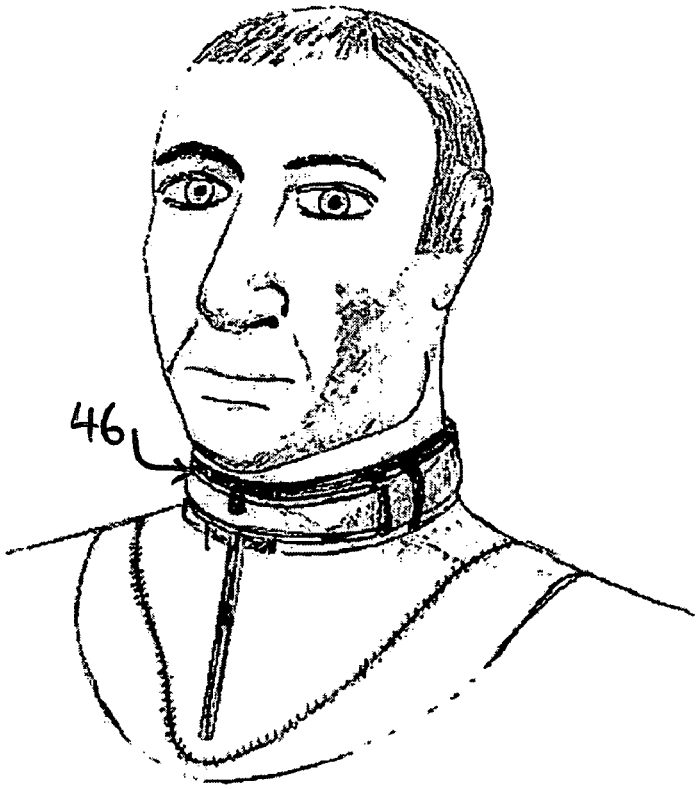
FIG. 18 is a perspective view of the neck seal of FIG. 15 closed around the neck of a wearer.
Figure 19:
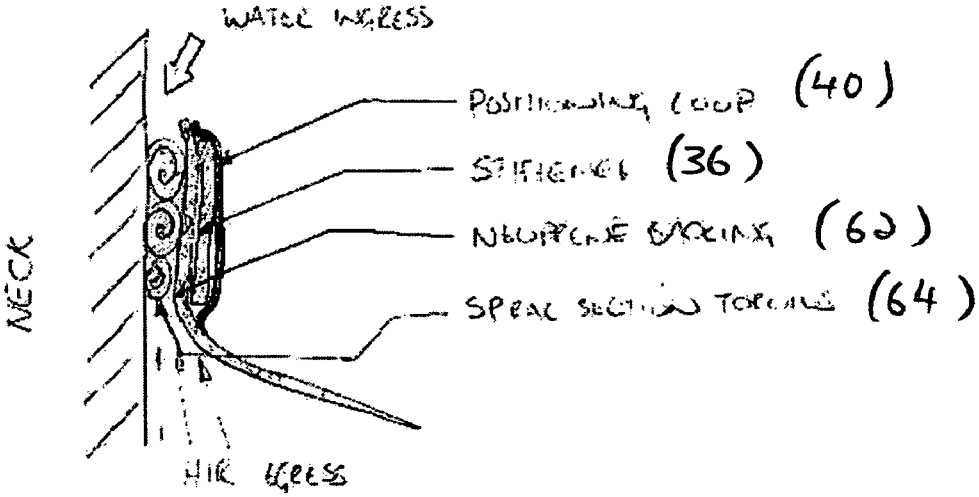
FIG. 19 is a cross-sectional side view of the neck seal of FIG. 15 against a wearer's neck.

To operate the sealing device, the zipper 60 is pulled up, as shown in FIG. 17, thereby bringing together each end of the non-stretch section 66. Then, the stiffener 36 is flipped up at the point of attachment 38, with the ends pulled around the wearer's neck and fastened together using the stiffener closure 46, as described with reference to FIG. 12. In a closed position, the stiffener 36 covers the zipper 60 over the wearer's neck (see FIG. 18).

Departing from the actual designs described above, many other concepts are possible for the seal element design. In this application the spiral section is one preferred approach because of a quick response speed, but in other applications different approaches may be suitable. For example, if long-term sealing is favored over speed, rather than using the spiral section design described for this application, a simple filled tube would be more suitable. The distribution of polymer, by type and quantity, could be varied to suit the specific application.

FIGS. 20 and 21 illustrate the behavior of two suitable polymer blends for use in the present invention. The performance was measured using a test that enabled the determination of total water absorption versus time for a polymer subjected to an arbitrary load. FIG. 20 describes the absorption of fresh water by a 0.25 gram polymer sample subjected to a 150 gram load over an area of 506.7 $mm^2$ (1" diameter). FIG. 21 describes the absorption of salt water (3.5% salt concentration) by a 0.5 gram polymer sample subjected to a 150 gram load over and area of 506.7 $mm^2$ (1" diameter). These results describe the performance of the polymer in terms of grams of water absorbed per gram of polymer value. Clearly the presence of sodium ions reduces the swelling ratio of the polymer, but unlike a standard polymer, this blend is able to minimize the effect of salinity to maintain good swelling performance in water with high salt concentration. Typical exponential behavior shows a very quick initial absorption of water, which gradually slows as the polymer becomes saturated and the osmotic pressure driving the absorption reduces. The reduction in swelling speed is initially gradual, but after about 200 seconds begins to increase, until the polymer is saturated and stops swelling altogether. Note that this swelling limit is a function of salinity, load, polymer blend composition, and effectiveness of water transport.

Figure 22:
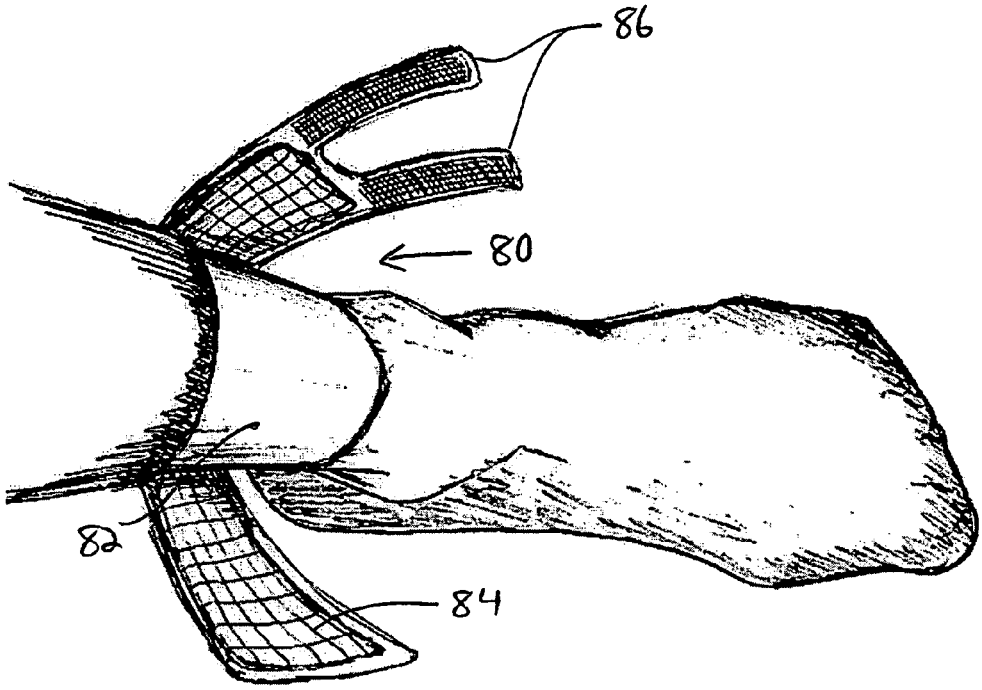
FIG. 22 is a perspective view of an ankle seal according to the present invention.
Figure 23:
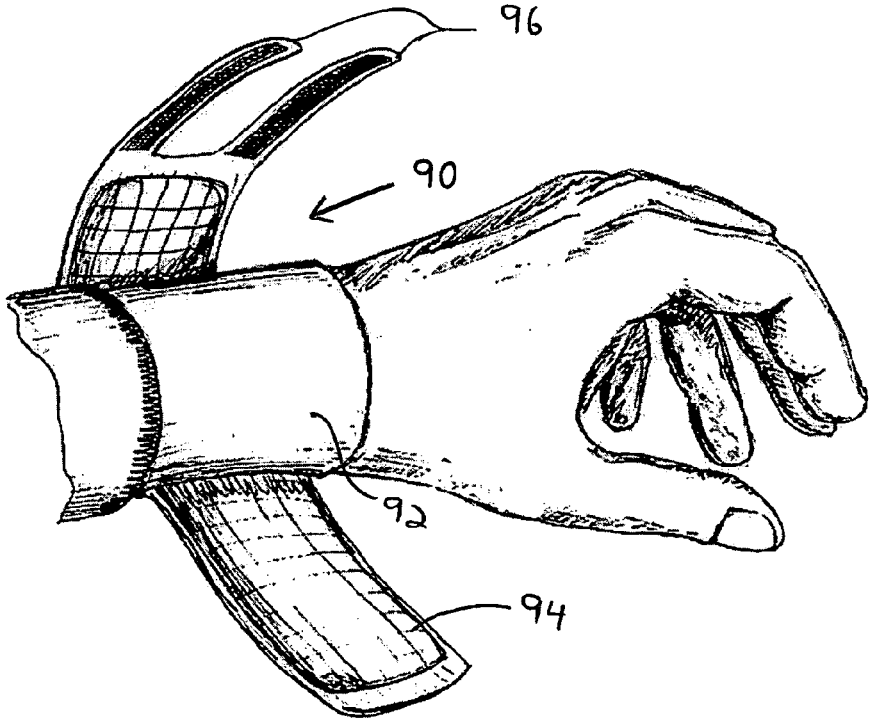
FIG. 23 is a perspective view of a wrist seal according to the present invention.

FIGS. 22 and 23 depict examples of an ankle seal 80 and a wrist seal 90, respectively, according to the present invention. The above-described first and second preferred embodiments are easily adapted to produce ankle and wrist seals that function on the same principles. The ankle and wrist seals preferably include at least a sealing element, an actuating element, and a force directing element.

As shown in FIG. 22, the ankle seal 80 is a sealing device configured to be wrapped around the ankle of a wearer, and includes at least a neoprene sealing membrane 82 (sealing element), a gel actuator pack 84 (actuating element), and a stiffener 86 (force directing element). The sealing membrane 82 preferably is similar to the neoprene primary seal 32 provided around the neck in FIG. 4. The sealing membrane 82 can be an extension of the body suit in the ankle area, or a separate element attached to the body suit. The gel actuator pack 84 preferably is removable and disposable, and is configured to be wrapped around the sealing membrane 82 (similar to the gel actuator pack 34 in FIG. 4). The stiffener 86 is disposed adjacent to the gel actuator pack 84, and can include portions extending through and/or contacting the gel actuator pack 84, similar to the embodiment of FIGS. 4 and 5. Operation of the ankle seal 80 is similar to the neck seal of FIGS. 4 and 5. Initially, the sealing membrane 82 is received over the wearer's ankle. Then, the gel actuator pack 84 and stiffener 86 are wrapped around the sealing membrane 82, such that the stiffener is fastened, e.g., using one of the mechanisms previously described. The ankle seal 80 can be deployed in a manner similar to the neck seal.

The wrist seal 90 is a sealing device configured to be wrapped around the wrist of the wearer, and includes at least a neoprene sealing membrane 92 (sealing element), a gel actuator pack 94 (actuating element), and a stiffener 96 (force directing element). The sealing membrane 92 corresponds to the sealing membrane 82 described above with reference to the ankle seal 80. The sealing membrane 82 can be an extension of the body suit as provided in the wrist area, or a separate element attached to the body suit. The gel actuator pack 94 corresponds to the gel actuator pack 84 described above, and preferably is removable and disposable, and configured to be wrapped around the sealing membrane 92. The stiffener 96 is disposed adjacent to the gel actuator pack 94, and can include portions extending through and/or contacting the gel actuator pack 94. Operation of the wrist seal 90 is similar to the ankle seal 80 of FIG. 22. Initially, the sealing membrane 92 is received over the wearer's wrist. Then, the gel actuator pack 94 and stiffener 96 are wrapped around the sealing membrane 92, such that the stiffener is fastened, which prepares the wrist seal for deployment in a manner previously described Other embodiments of the present invention can be applied to the solution of a host of problems in which an emergency seal or a seal that reacts to certain conditions is required. For example, a seal that allows ventilation when dry but shuts off the entry of water when wet could be usefully employed in protecting homes and basements from flooding. Such a seal could be employed around door and window frames in such a way that it would normally not be in contact with water, but that in the event of submersion it would quickly expand to seal off further water ingress. Going further, a seal that reacts to the presence of water could be used in shaft designs to serve as an emergency backup seal and indicator that the main seal around a shaft may have failed. Such a shaft could be the shaft that drives a mixer in an industrial process or the propeller shaft on a boat. These are just a few of the potential applications for this invention and demonstrate the wide applicability of the invention.

Figure 24:
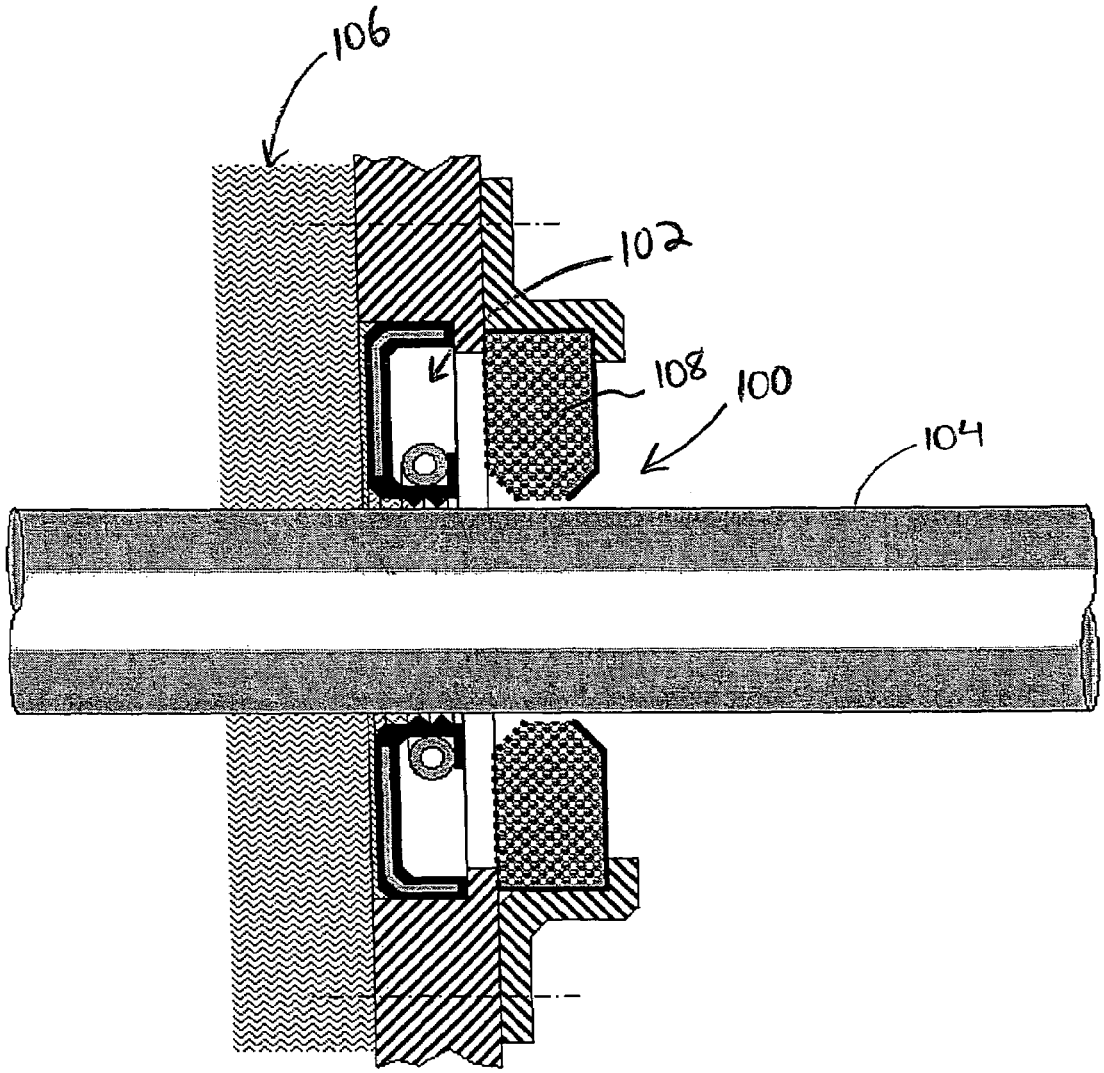
FIG. 24 is a schematic view of a shaft sealing device in which a secondary seal is in a first, standby state.
Figure 25:
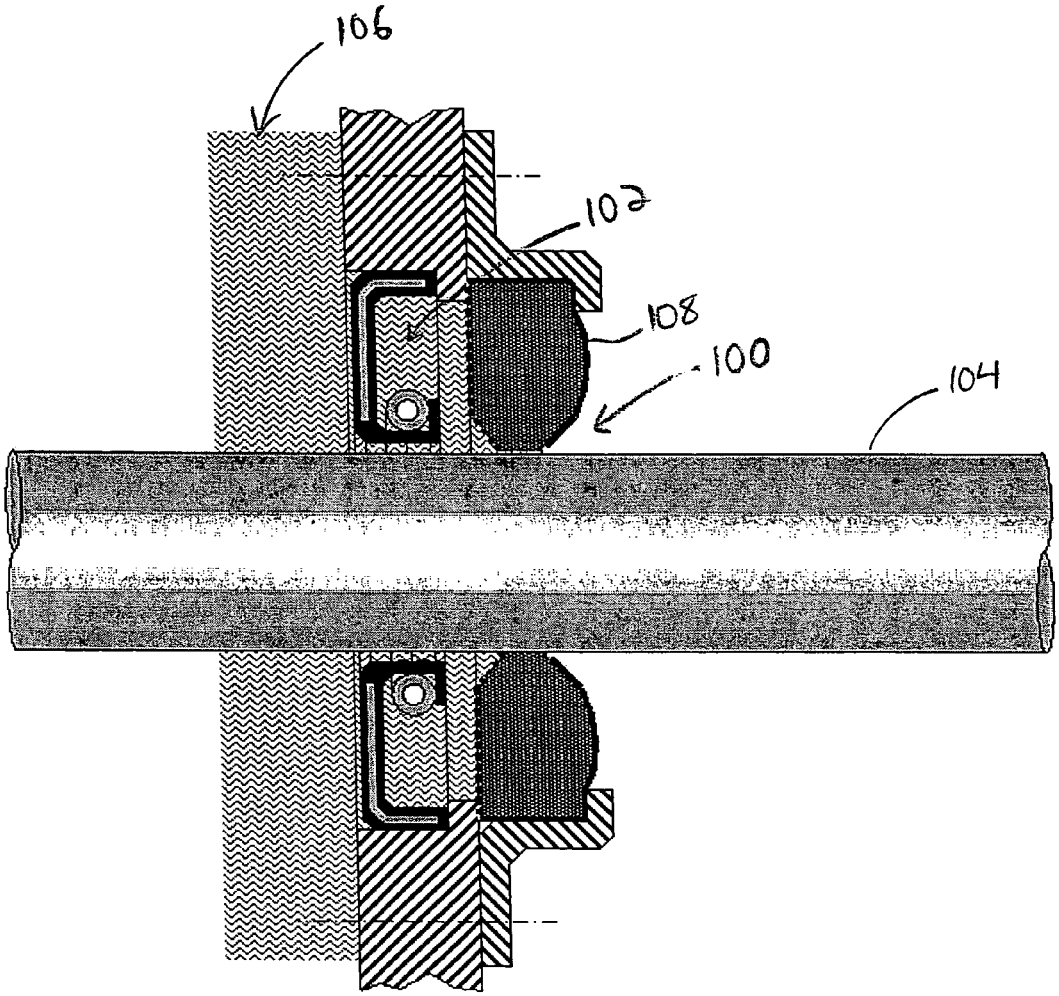
FIG. 25 is a schematic view of the shaft sealing device of FIG. 27 in which the secondary seal is in a second, deployed state.

As shown in FIGS. 24 and 25, one application is a shaft seal for use as an emergency secondary device that could also indicate the failure of a primary seal. Under some circumstances it may even be desirable for this device to serve as the primary seal. Such a secondary seal could be designed to be in close proximity of the primary, conventional seal and in close proximity to the shaft. As shown in FIG. 24, a shaft 104 is sealed by a primary seal 102 to prevent ingress of water from a body 106 containing a fluid medium such as water. The primary seal 102 can be any type of conventional seal used to seal the shaft 104; as depicted in FIG. 24, the primary seal 102 is functioning properly and has not been breached. In FIG. 24, a secondary seal 100 is arranged behind the primary seal 102. In certain embodiments, sealing can be accomplished solely by use of the secondary seal, and the primary seal can be omitted.

The secondary seal 100 preferably incorporates a swelling polymer 108, e.g., of the type described above with respect to body suits, such that that the polymer absorbs water that has flowed past the primary seal 102, thereby re-sealing the shaft 104. As depicted in FIG. 24, the polymer 108 contained in the secondary seal 100 is in a non-swollen state.

As shown in FIG. 25, the primary seal 102 has been breached, and water has leaked beyond the primary seal 102 into a space that was previously dry. In the event of primary seal failure, whether catastrophic or minor, water or another fluid that flows past the primary seal can be absorbed by the secondary seal 100. At the point where enough water has flown through to sufficiently enlarge the secondary seal 100, it would shut off flow and, if so designed, swell on the dry side to indicate its deployment to anyone inspecting it. Again, the type and quantity of polymer or combinations of polymers would be determined to suit the application. For example, the polymer can be a polymer blend that incorporates a superabsorbent hydrogel, such as one that includes sodium polyacrylate and poly-anionic beads (PAB).

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications and other references cited herein are hereby expressly incorporated herein in their entireties by reference.

What is claimed is:

1. A sealing device for a body suit, comprising:

a sealing element arranged around a wearer, the sealing element being formed of a substantially impermeable material;

an actuating element including at least one layer of a permeable stretch material, the at least one layer incorporating a polymer blend that irreversibly swells in the presence of a fluid medium, the polymer blend having an affinity for sodium ions in the fluid medium; and a force directing element made of non-stretch material, the force directing element configured to direct swelling of the actuating element to apply sealing pressure against the sealing element arranged around the wearer.

2. The sealing device of claim 1, wherein the sealing and actuating elements are integral.

3. The sealing device of claim 2, wherein the integral sealing and actuating elements are formed as a tube or spiral.

4. The sealing device of claim 3, wherein the tube or spiral includes one or more toroid rings in contact with the wearer.

5. The sealing device of claim 4, wherein the toroid rings have split surfaces to accommodate a zipper.

6. The sealing device of claim 1, wherein the sealing and actuating elements are separate.

7. The sealing device of claim 1, wherein the actuating element is contained in a gel actuator pack.

8. The sealing device of claim 7, wherein the force directing element is a stiffener attached to the gel actuator pack.

9. The sealing device of claim 7, wherein the gel actuator pack is attached to the sealing element.

10. The sealing device of claim 1, wherein the sealing element is made of neoprene, latex, silicone rubber, or rubber coated fabric.

11. The sealing device of claim 1, wherein the polymer blend in the actuating element is a superabsorbent hydrogel.

12. The sealing device of claim 11, wherein the superabsorbent hydrogel includes sodium polyacrylate and poly-anionic beads (PAB).

13. The sealing device of claim 11, wherein the superabsorbent hydrogel includes about 50% polyacrylate and about 50% poly-anionic beads (PAB).

14. The sealing device of claim 1, wherein upon exposure to water, the actuating element swells and tightens around the wearer within about 10 to 15 seconds.

15. The sealing device of claim 1, wherein the force directing element is a stiffener made of non-stretch fabric.

16. The sealing device of claim 1, wherein the fluid medium is water.

17. The sealing device of claim 1, wherein the fluid medium is fresh water or salt water with sodium ion concentrations of up to about 10%.

18. The sealing device of claim 1, wherein the sealing device is a neck seal.

19. The sealing device of claim 1, wherein the sealing device is an ankle seal.

20. The sealing device of claim 1, wherein the sealing device is a wrist seal.

21. A method of sealing a body suit, comprising the steps of:

providing a sealing device including a sealing element formed of a substantially impermeable material, an actuating element including at least one layer of a permeable stretch material, the at least one layer incorporating a polymer blend that irreversibly swells in the presence of a fluid medium, the polymer blend having an affinity for sodium ions in the fluid medium, and a force directing element made of a non-stretch material;

arranging the sealing element around a wearer;

engaging a force directing element around the wearer such that the force directing element covers at least the sealing element; and exposing the sealing device to the fluid medium such that the polymer blend swells and seals against the sealing element arranged around the wearer of the body suit.

22. A device for sealing a shaft between a wet body and a dry space, comprising:

a sealing element formed of a substantially impermeable material arranged around the shaft; and an actuating element contained within the sealing element, the actuating element including at least one layer of a permeable stretch material, the at least one layer incorporating a polymer blend that irreversibly swells in the presence of a fluid medium, the polymer blend having an affinity for sodium ions in the fluid medium preventing ingress of the fluid medium into the dry space.

23. The device of claim 22, wherein the device is arranged behind a primary seal to prevent ingress of the fluid medium into the dry space upon failure of the primary seal.

24. The device of claim 22, wherein the polymer blend in the actuating element is a superabsorbent hydrogel.

25. The device of claim 24, wherein the superabsorbent hydrogel includes sodium polyacylate and poly-anionic beads (PAB).

* * * * *